US011679575B2

(12) United States Patent
Schweikhardt et al.

(10) Patent No.: US 11,679,575 B2
(45) Date of Patent: Jun. 20, 2023

(54) METHOD AND DEVICE FOR ROTARY BLIND EMBOSSING OF A SUBSTRATE, A FEMALE DIE AND/OR A MALE DIE FOR USE IN A DEVICE, AND A METHOD FOR PRODUCING A FEMALE DIE AND/OR A MALE DIE

(71) Applicants: Hinderer + Mühlich GmbH & Co. KG, Göppingen (DE); Koenig & Bauer AG, Würzburg (DE)

(72) Inventors: René Schweikhardt, Remshalden (DE); Thomas Löchner, Ebersbach/Fils (DE); Johannes Naumann, Weinböhla (DE); Johannes Helbig, Dresden (DE)

(73) Assignees: Hinderer + Mühlich GmbH & Co. KG, Göppingen (DE); Koenig & Bauer AG, Würzburg (DE)

( * ) Notice: Subject to any disclaimer, the term of this patent is extended or adjusted under 35 U.S.C. 154(b) by 444 days.

(21) Appl. No.: 16/956,338

(22) PCT Filed: Jan. 28, 2019

(86) PCT No.: PCT/EP2019/052009
§ 371 (c)(1),
(2) Date: Jun. 19, 2020

(87) PCT Pub. No.: WO2019/154659
PCT Pub. Date: Aug. 15, 2019

(65) Prior Publication Data

US 2021/0078281 A1 Mar. 18, 2021

(30) Foreign Application Priority Data

Feb. 6, 2018 (DE) ..... 102018102638.2

(51) Int. Cl.
*B31F 1/07* (2006.01)
*B41F 19/06* (2006.01)
(Continued)

(52) U.S. Cl.
CPC ..... *B31F 1/07* (2013.01); *B41F 19/02* (2013.01); *B41F 19/062* (2013.01);
(Continued)

(58) Field of Classification Search
CPC ..... B31F 1/07; B31F 2201/0738; B31F 2201/0743; B31F 2201/0776; B31F 19/02;
(Continued)

(56) References Cited

U.S. PATENT DOCUMENTS 4,732,082 A * 3/1988 Ireton ..... B41F 19/02 101/23
4,878,407 A * 11/1989 Harrison ..... B41F 27/12 269/21
(Continued)

FOREIGN PATENT DOCUMENTS

DE 10040683 A1 3/2002
DE 102004014373 A1 10/2005
(Continued)

*Primary Examiner* — Jill E Culler
(74) *Attorney, Agent, or Firm* — Hoffmann & Baron, LLP

(57) ABSTRACT

A method for the rotary blind embossing of a substrate, a device for the rotary blind embossing of a substrate, a female die and/or a male die for use in a device, and to a method for producing a female die and/or a male die. The method for the rotary blind embossing of a substrate in a work station including an embossing roller and a counter-pressure roller includes the following steps: a) preparing the substrate; b) blind embossing the substrate by means of at least one female die provided on the embossing roller and at least one male die provided on the counter-pressure roller. The device
(Continued)

for the rotary blind embossing of a substrate has a work station having an embossing roller and a counter-pressure roller, at least one female die being provided on the embossing roller and at least one male die being provided on the counter-pressure roller.

25 Claims, 10 Drawing Sheets

(51) Int. Cl.
*B44B 5/00* (2006.01)
*B44B 5/02* (2006.01)
*B41F 19/02* (2006.01)

(52) U.S. Cl.
CPC ..... *B44B 5/0009* (2013.01); *B44B 5/0047* (2013.01); *B44B 5/026* (2013.01); *B31F 2201/0738* (2013.01); *B31F 2201/0743* (2013.01); *B31F 2201/0776* (2013.01)

(58) Field of Classification Search
CPC ... B31F 19/062; B44B 5/0009; B44B 5/0047; B44B 5/026
See application file for complete search history.

(56) References Cited

U.S. PATENT DOCUMENTS

| | | | | |
|---|---|---|---|---|
| 5,505,125 | A * | 4/1996 | Kapolnek | B29C 59/002 101/22 |
| 6,766,733 | B1 * | 7/2004 | Collins | B26F 1/44 101/372 |
| 9,636,885 | B2 * | 5/2017 | Boegli | B44B 5/026 |
| 2004/0035311 | A1 | 2/2004 | Moll | |
| 2008/0245249 | A1 | 10/2008 | Muhlich | |

FOREIGN PATENT DOCUMENTS

| | | | |
|---|---|---|---|
| DE | 102006003037 | A1 | 7/2006 |
| DE | 102006014383 | A1 | 10/2007 |
| WO | 2007028557 | A1 | 3/2007 |

* cited by examiner

METHOD AND DEVICE FOR ROTARY BLIND EMBOSSING OF A SUBSTRATE, A FEMALE DIE AND/OR A MALE DIE FOR USE IN A DEVICE, AND A METHOD FOR PRODUCING A FEMALE DIE AND/OR A MALE DIE

This application claims priority based on an International Application filed under the Patent Cooperation Treaty, PCT/EP2019/052009, filed Jan. 28, 2019, which claims priority to DE 102018102638.2, filed Feb. 6, 2018.

BACKGROUND OF THE INVENTION

The invention relates to a method for rotary blind embossing of a substrate, a device for rotary blind embossing of a substrate, a female die and/or male die for use in a device, and a method for producing a female die and/or male die.

Blind embossing is widely used for the finishing of substrates, such as for example packaging. Here, a particular pattern, motif or lettering is produced by means of a female die and a male die in the substrate. In the case of embossing, the pattern, motif or lettering is raised, in the case of debossing it is depressed into the substrate. In the case of blind embossing, large stamps or plates are typically used in order to emboss the pattern, motif or the lettering in the substrate. In order to be able to produce a large number of types and thicknesses of deformation, such as steep edges, different angles or simultaneously embossed and debossed elements, a vertical stamping method or a vertical stamping device is often used, since the desired large number of deformations can be realized with high quality here. In the case of vertical stamping, the deformation is effected in a vertical movement, in particular through the pressure transferred by the stamping tool. Although a large number of deformations can be produced with this method, it is disadvantageous that at most approximately 8000 sheets per hour can be processed by means of the established vertical stamping methods or vertical stamping devices. Further, the human and/or mechanical effort is increased in the case of vertical stamping, since for the stamping process the substrate to be stamped has to be placed and aligned, in each case individually, in the vertical stamping device.

SUMMARY OF THE INVENTION

The object of the invention is now to provide an improved method and an improved device for blind embossing of a substrate. A further object of the invention is to provide an improved female die and/or male die for use in a method and a device for blind embossing.

This object is achieved by a method for rotary blind embossing of a substrate in a work station comprising an embossing roller and a counter-pressure roller, wherein the method comprises the following steps, which are performed in particular in the following sequence: a) providing the substrate; b) blind embossing the substrate by means of at least one female die arranged on the embossing roller and at least one male die arranged on the counter-pressure roller. This object is further achieved by a device for rotary blind embossing of a substrate, in particular for carrying out a method according to one of claims 1 to 22, wherein the device comprises a work station which comprises an embossing roller and a counter-pressure roller, and wherein at least one female die is arranged on the embossing roller and at least one male die is arranged on the counter-pressure roller. This object is further achieved by a female die and/or male die for use in a device according to one of claims 23 to 50 and/or for use in a method according to one of claims 1 to 22. This object is also achieved by a method for producing a female die and/or male die, in particular for use in a device according to one of claims 23 to 50 and/or for use in a method according to one of claims 1 to 22, according to one of claims 51 to 63, wherein the method comprises the following steps: defining the shape of at least one elevation and/or recess in the surface of the female die and/or male die, in particular by means of software; producing the at least one elevation and/or recess in the surface of the female die and/or male die.

It has been shown here that the number of sheets processed can be significantly increased compared with vertical stamping methods or with vertical stamping devices through the method for rotary blind embossing of a substrate and through the device for rotary blind embossing of a substrate, wherein at the same time an embossing result which is comparable in terms of quality with vertical stamping is achieved. Considerable cost savings can be achieved hereby. Further, the human and mechanical effort is reduced, since the rotary blind embossing method is preferably performed continuously and thus a manual insertion of the substrate into the embossing device, for example, is dispensed with. Further, in particular when the method is used in combination with further method steps, such as for example punching, grooving or printing, in a common continuous method, on the one hand the processing speed is further increased and on the other hand a high registration accuracy, for example between a print and the embossing, is achieved, since the rotary method can be combined with other rotary methods, such as punching, grooving or printing. The mechanical and human effort and thus the costs can be further reduced through such an in-line combination.

By blind embossing is meant here in particular a relief embossing without the use of an ink, in particular a printing ink, and/or without the use of a transfer film, in particular a hot-stamping film or cold-stamping film. A pattern, motif or lettering is preferably embossed in the substrate, wherein in particular in the case of an embossing the pattern, motif or lettering is raised and/or in the case of a debossing the pattern, motif or lettering is depressed into the substrate.

By a female die is meant here in particular an embossing tool which has the corresponding relief shape as elevations and/or recesses, wherein the female die preferably has the relief shape of the relief embossing to be achieved in a mirrored arrangement, i.e. thus a not immediately readable arrangement.

By a male die is meant here in particular an embossing tool which has the corresponding relief shape as elevations and/or recesses, wherein the male die preferably has the relief shape of the relief embossing to be achieved in a non-mirrored arrangement, i.e. thus in a readable arrangement.

Female die and male die fit together in particular such that the relief embossing is formed in the substrate in readable form. Preferably, for this purpose the female die acts on the substrate from the upper side and the male die acts on the substrate from the underside, wherein the upper side of the substrate represents the viewing side in the later use form of the substrate.

Female die and male die can in particular also be arranged reversed with respect to the arrangement described above if, for example, a transparent substrate is to be viewed from the underside of the substrate in the later use form.

By register or registration, or register accuracy or registration accuracy, is meant in particular a positional accuracy of two or more elements and/or layers relative to each other, here for example the positionally accurate arrangement of the embossing and further features applied to the substrate, such as for example a print, layers and/or fold or crease lines applied to the substrate, relative to each other. The register accuracy is advantageously to vary within a predefined tolerance, which is to be as small as possible. At the same time, the register accuracy of several elements and/or layers relative to each other is expediently an important feature for increasing the process reliability. The positionally accurate positioning can be effected in particular by means of sensory, preferably optically detectable, registration marks or register marks. These registration marks or register marks can either represent special separate elements or regions or layers or themselves be part of the elements or regions or layers to be positioned.

Further advantageous embodiments of the invention are described in the dependent claims.

It is advantageous if in step b) the substrate is blind-embossed such that the substrate has at least one elevation and/or depression.

By an elevation and/or depression of the substrate is meant in particular a relief shape which represents a pattern, motif or lettering and which is preferably arranged either elevated (embossing) or depressed (debossing) relative to an unprocessed region of the substrate.

An elevation of the substrate is preferably an embossing, with the result that the pattern, motif or lettering is raised in the substrate. A depression of the substrate is preferably a debossing, with the result that the pattern, motif or lettering is depressed into the substrate.

Further, it is advantageous if the at least one elevation and/or depression of the substrate is produced in step b) with a height and/or depth of at least 0.02 mm, preferably at least 0.05 mm, further preferably at least 0.1 mm, still further preferably at least 0.5 mm. Optically and haptically attractive blind embossings can hereby be produced.

Preferably, the method further comprises the following steps, which are carried out in particular before step a) and/or step b): fixing the at least one female die on the embossing roller and/or the at least one male die on the counter-pressure roller by means of a fixing device. Thus, it is possible for the at least one female die to be firmly fixed on the embossing roller and/or the at least one male die to be firmly fixed on the counter-pressure roller by means of a fixing device. The fixing device is expediently a pin, bolt or a screw. Further, it is advantageous if the embossing roller and/or the counter-pressure roller has a plurality of holes into which the fixing device can be introduced. It can hereby be achieved that the female die and/or male die can be fixed at points predefined by the plurality of holes.

Further, it is also possible for the at least one female die to be introduced directly as at least one elevation and/or recess into the surface of the embossing roller and/or for the at least one male die to be introduced directly as at least one elevation and/or recess into the surface of the counter-pressure roller. The female die and/or the male die can thus in particular be a solid tool, which is in particular designed completely solid in one piece or partially solid in one piece at least in the region of the embossing tools. A mechanically extremely stable embossing roller with introduced female die and a mechanically extremely stable counter-pressure roller with introduced male die are hereby provided, which is useful in particular in the case of few modifications of the device for relief shapes to be embossed differently or in the case of relief shapes to be embossed uniformly.

It is also possible for the at least one female die to be introduced as at least one elevation and/or recess into the surface of an embossing cylinder which is arranged detachably on the embossing roller and/or for the at least one male die to be introduced as at least one elevation and/or recess into the surface of a counter-pressure cylinder which is arranged detachably on the counter-pressure roller. A quick modification can hereby be achieved in particular compared with a solid tool, since only the embossing cylinder and/or the counter-pressure cylinder has to be changed.

According to a further embodiment example of the invention, the embossing roller and/or the counter-pressure roller is magnetic or formed magnetic, in particular the embossing roller and/or the counter-pressure roller is designed as a magnetic cylinder. An easy and quick setup of the device can hereby be guaranteed.

It is advantageous if the device has a positioning aid with at least one window region, wherein the positioning aid is arranged on the embossing roller and/or the counter-pressure roller and the at least one female die and/or male die is arranged in the at least one window region of the positioning aid.

Thus, it is possible for the method to further comprise the following steps, which are carried out in particular before step a) and/or step b): providing a positioning aid comprising at least one window region; arranging the positioning aid on the embossing roller and/or the counter-pressure roller; arranging the at least one female die and/or male die in the at least one window region of the positioning aid.

This makes it possible for the female die and/or male die to be arranged in predetermined positions, which are determined by the window regions of the positioning aid, wherein for one thing a quick and thus cost-effective setup of the device becomes possible, since for example the comparatively rough positioning is substantially predefined by the window regions, and for another an in particular registration-accurate alignment of the female die and/or male die within the window regions is furthermore possible, in order to be able to compensate for tolerances. Hereby, a plurality of relief shapes, for example also the simultaneous use of embossings and debossings can further be realized, since only the female die and/or male die with the corresponding relief shapes within the window regions have to be changed and also any desired relief shapes can be combined with one another in particular in the individual window regions with one another.

By region is meant here in particular in each case a defined surface area which is occupied when viewed perpendicular to a plane spanned by the positioning aid. Thus, for example, the positioning aid, in particular in the flat state, has one or more window regions, wherein each of the window regions in each case occupies a defined surface area when viewed perpendicular to a plane spanned by the positioning aid.

Preferred embodiments of the positioning aid are described, among other things, in the following:

The positioning aid expediently has two or more window regions, wherein the two or more window regions are in particular arranged according to a one- or two-dimensional grid.

Further, it is expedient if the outline of the at least one window region of the positioning aid substantially corresponds to the outline of the at least one female die and/or male die.

By outline is meant here in particular the contours or outer contours of the window region or of the male die and/or female die, which are occupied when viewed perpendicular to a plane spanned by the positioning aid or the female die and/or male die.

The at least one window region of the positioning aid is advantageously larger than the at least one female die and/or male die, in particular the distance from each edge of the at least one window region to the at least one female die and/or male die is at least 0.1 mm, preferably 0.2 mm, still further preferably 0.3 mm. This ensures on the one hand that the basic positioning of the female die and/or male die is correct and on the other hand that the female die and/or male die can furthermore be arranged adjustably, in particular registration-accurate, within the distance from each edge of the respective window region to the female die and/or male die arranged in each case within the window region, in order to be able to compensate for tolerances, for example.

The positioning aid preferably comprises metals, in particular copper, nickel, chromium, iron, zinc, tin, lead or alloys of such metals.

Further, it is possible for the positioning aid to be magnetic or to be formed magnetic. A simple and quick arrangement of the positioning aid on the preferably magnetically formed embossing roller and/or the preferably magnetically formed counter-pressure roller can hereby be achieved.

It is also advantageous if the positioning aid has a thickness of at least 0.25 mm, preferably of at least 0.5 mm, further preferably of at least 0.75 mm.

Further, it is possible for the positioning aid to have a thickness that is increased compared with the remaining thickness of the positioning aid in a region around the at least one window region, in particular for the positioning aid to have a thickness that is increased by at least 0.1 mm, preferably by at least 0.2 mm, further preferably by at least 0.3 mm, compared with the remaining thickness of the positioning aid in a region around the at least one window region. Here, it has been shown that the stability can be increased and thus the embossing result can be improved through the increased thicknesses of the positioning aid around the window regions, in particular since displacements and/or mechanical movements of the female die and/or male die are preferably prevented or reduced due to the higher mechanical stability.

It is also possible for the region around the at least one window region to have a width of at least 0.2 mm, preferably of at least 0.5 mm, further preferably of at least 1.5 mm.

Furthermore, it is possible for the positioning aid to have a width of at least 250 mm, preferably of at least 500 mm, further preferably of at least 750 mm, and a length of at least 500 mm, preferably at least 750 mm, further preferably of at least 1000 mm, and/or for the at least one window region to have a width of at least 5 mm, preferably at least 10 mm, further preferably of at least 20 mm, and a length of at least 10 mm, preferably at least 20 mm, further preferably of at least 100 mm.

It is useful if the positioning aid is clamped onto the embossing roller and/or the counter-pressure roller, in particular if the positioning aid is clamped onto the embossing roller and/or the counter-pressure roller such that the positioning aid has a curvature which substantially corresponds to the diameter of the embossing roller and/or the diameter of the counter-pressure roller. Thus, it is also possible for the positioning aid to be clamped onto the embossing roller and/or the counter-pressure roller, in particular for the positioning aid to be clamped onto the embossing roller and/or the counter-pressure roller such that the positioning aid has a curvature which substantially corresponds to the diameter of the embossing roller and/or the diameter of the counter-pressure roller.

By curvature is preferably meant here a radius of curvature, wherein the radius of curvature corresponds in particular to the radius of an osculating circle, which at a particular point of a curve is the circle which best approximates the curve at this point.

The positioning aid and/or the embossing roller and/or the counter-pressure roller preferably has a clamping device for this purpose. The clamping device of the positioning aid expediently has holes, by means of which the positioning aid can be fastened on the embossing roller and/or the counter-pressure roller, for example by means of pins or screws.

The positioning aid preferably encompasses the embossing roller and/or the counter-pressure roller completely. However, it is also possible for the positioning aid to encompass the embossing roller and/or the counter-pressure roller only partially. For example, it is possible for the positioning aid to encompass half of the embossing roller and/or the counter-pressure roller, with the result that the positioning aid would form a semicircle. Other partial encompassing, such as for example in the form of a three-quarter circle or a quarter circle, is further conceivable.

It is also possible for the embossing roller and/or the counter-pressure roller to have several positioning aids, which encompass the embossing roller and/or the counter-pressure roller completely or only partially. For example, two positioning aids can in each case encompass half of the embossing roller and/or the counter-pressure roller. However, any other subdivisions and/or distributions of several positioning aids on the embossing roller and/or the counter-pressure roller are also feasible.

According to a further embodiment example of the invention, the at least one female die and the embossing roller and/or the at least one male die and the counter-pressure roller in each case represent two different components of the device, in particular the at least one female die and/or male die is applied to the surface of the embossing roller and/or of the counter-pressure roller in the at least one window region of the positioning aid. A quick and easy setup and/or change of the setup of the device can hereby be achieved, since only the female die and/or male die, which are small compared with the embossing roller and/or the counter-pressure roller, have to be changed. In particular in combination with a positioning aid, a quick and at the same time precise setup of the device for the desired embossing relief shapes can be achieved here.

Preferred embodiments of the female die and/or male die as well as the arrangement or design of the female die and/or male die in the device for rotary blind embossing are described, among other things, in the following. The use of the female die and/or male die in the method and/or the device for rotary blind embossing is further described:

The at least one female die and/or male die is preferably deformed such that the at least one female die and/or male die has a curvature which substantially corresponds to the diameter of the embossing roller and/or substantially corresponds to the diameter of the counter-pressure roller. Thus, it is also possible for the at least one female die and/or male die to be deformed, before being arranged in the at least one window region of the positioning aid, such that the at least one female die and/or male die has a curvature which substantially corresponds to the diameter of the embossing roller and/or the diameter of the counter-pressure roller. It is also possible for the female die and/or male die to be rounded, in particular for the female die and/or male die to be deformed such that the female die and/or male die has a curvature which substantially corresponds to the diameter of an embossing roller and/or the diameter of a counter-pressure roller, on which the female die and/or male die is arranged.

A matching of the shape of the female die and/or male die to the shape of the embossing roller and/or counter-pressure roller is hereby achieved, with the result that the female die and/male die can be used in the rotary methods.

It is advantageous if the female die and/or male die has at least one elevation and/or recess which corresponds in particular, in positive and/or negative form, to the relief shape to be embossed. Further, it is possible for the at least one elevation and/or recess to represent a pattern, motif or lettering. A pattern can be, for example, a graphically designed outline, a figurative representation, an image, a symbol, a logo, a portrait and the like. Lettering can be, for example, an alphanumeric character, a text and the like.

Further, it is advantageous that the at least one elevation of the female die and/or of the male die has a height of at most 5.0 mm, preferably of at most 3.0 mm, further preferably of at most 1.0 mm, still further preferably of at most 0.5 mm, and/or that the at least one recess of the female die and/or of the male die has a depth of at most 5.0 mm, preferably of at most 3.0 mm, further preferably of at most 1.0 mm, still further preferably of at most 0.5 mm.

It is possible for the at least one elevation and/or recess of the female die and/or of the male die to have a shape selected from the group: round, flat, round and flat, flat and angular, prismatic, prismatic and flat, pointed or mixed forms of these shapes.

Further, it is possible for the at least one elevation and/or recess of the female die and/or male die to be designed multi-level, in particular sculptured, in its height and/or its depth.

By sculptured is preferably meant a relief shape which represents or forms a sculpture, a motif, a pattern or lettering.

The at least one elevation and/or recess of the female die and/or male die preferably has at least one side edge, wherein the angle between the at least one side edge and a line running parallel to the surface of the female die and/or male die is between 0° and 180°, preferably between 45° and 135°, further preferably between 80° and 100°, still further preferably between 85° and 95°.

Further, it is expedient if the at least one elevation and/or recess has a round shape such that the shape of the elevation and/or recess is substantially defined by a sector of a circle, in particular with a radius between 0.1 mm and 2.5 mm, preferably between 0.3 mm and 0.7 mm. The shape of the elevation and/or recess can also be substantially elliptical, wherein the smaller radius of the ellipse has a dimension between 0.1 mm and 2.5 mm, preferably between 0.3 mm and 0.7 mm.

Advantageously, the at least one female die is magnetically attached to the embossing roller and/or the at least one male die is magnetically attached to the counter-pressure roller. It is hereby possible that the female die and/or male die can be quickly and easily arranged on the embossing roller and/or the counter-pressure roller.

According to a further embodiment example of the invention, the at least one female die is arranged on the embossing roller and the at least one male die is arranged on the counter-pressure roller such that the retention force with which the at least one female die is arranged on the embossing roller is higher, is preferably 1.5 to 5 times higher, is further preferably 2.5 to 3.5 times higher, than the retention force with which the at least one male die is arranged on the counter-pressure roller. Thus, it is also possible for the at least one female die to be arranged on the embossing roller and the at least one male die to be arranged on the counter-pressure roller such that the retention force with which the at least one female die is arranged on the embossing roller is higher, is preferably 1.5 to 5 times higher, is further preferably 2.5 to 3.5 times higher, than the retention force with which the at least one male die is arranged on the counter-pressure roller.

The retention force was in particular measured in the longitudinal direction of the female die or male die. In particular, the measuring force transmission was effected via 50 mm-wide TESA 4651 adhesive tape stuck to the surface of the female die or male die and a hanging loop on the adhesive tape with a length, and thus a distance from the sample, of approx. 100 mm. In this measurement method, the measuring force acts in particular tangentially to the roller surface. In particular the static frictional force is determined as maximum force by means of an electronic spring force gauge (ALLURIS FMI100C5/500 N). The roller surface and also the surface of the female die and male die were in each case advantageously cleaned and de-oiled.

It is hereby achieved that the male die is arranged less firmly compared with the female die. The male die is thus in particular arranged "more loosely" than the female die. Here, it has been shown that embossings that are comparable in terms of quality in particular with the vertical stamping method can nevertheless be achieved by means of such a relatively lower retention force of the male die on the counter-pressure roller compared with the female die on the embossing roller, since the male die in particular has advantageous degrees of freedom due to the lower retention force such that it can occupy the ideal position in relation to the female die forming the counterpart. In particular, the male die in a manner of speaking "finds" the ideal position. This advantageously makes a self-adjustment possible, which provides a high-quality embossing result. Further, the effort to set up and/or change the setup of the device is significantly reduced through such an automatic self-alignment or positioning of the male die with respect to the female die, since the ideal positioning or alignment is brought about substantially automatically by the defined lower retention force of the male die compared with the female die. A high-quality embossing result is produced here in particular in combination with the positioning aid, since the male die then virtually locks in the ideal position with respect to the female die, as described above, wherein too great a play of the male die is prevented through the limitation by the window region of the positioning aid, in which the male die is arranged.

Further, it is advantageous if the at least one female die and/or male die can be adjusted by means of an adjusting aid in the at least one window region of the positioning aid. Thus, it is also possible, when the at least one female die and/or male die is arranged in the at least one window region of the positioning aid, for the at least one female die and/or male die to be adjusted by means of an adjusting aid in the at least one window region.

The adjusting aid expediently consists, for example, of one or more plates, in particular of one or more gauge blocks and/or one or more feeler gauges, which are in particular inserted into the gap between female die and/or male die and the edge of the window region. The gap is preferably formed in that the at least one window region is larger than the at least one female die and/or male die. In particular, the gap corresponds to the distance from each edge of the at least one window region to the at least one female die and/or male die. It is hereby possible to adjust the female die and/or male die, in particular to compensate for tolerances, with the result that a registration-accurate embossing result can be achieved.

The adjusting aid is preferably arranged such that the at least one female die and/or male die is movable, in particular flexible, at least in one direction.

The adjusting aid is advantageously arranged such that the female die and/or male die is movable, in particular flexible, in a direction parallel to the feed direction of the substrate. However, it is also possible for the adjusting aid to be arranged such that the at least one female die and/or male die is movable, in particular flexible, in a direction perpendicular to the feed direction of the substrate. The at least one female die and/or male die is preferably arranged movable, in particular flexible, in a gap which corresponds to the distance from each edge of the at least one window region to the at least one female die and/or male die.

Thus, it is possible for the adjusting aid to be arranged on one or two, in particular two opposite sides of the window region. For example, the adjusting aid is arranged on the sides of the window region which run parallel to the longitudinal axis or to the transverse axis of the positioning aid. The adjusting aid is preferably arranged on the sides of the window region that are parallel to the rotational direction or rolling direction of the embossing roller and/or counter-pressure roller. However, it is also possible for the adjusting aid to be arranged on the sides of the window region that are perpendicular to the rotational direction or rolling direction of the embossing roller.

This makes it possible for the at least one female die and/or male die to still have a play at least in one direction in spite of the use of an adjusting aid, with the result that self-adjustment described above is made possible at least in one direction.

It is expedient if the at least one female die and/or male die is fastened by means of a fastening device in the at least one window region of the positioning aid. Thus, it is possible, when the at least one female die and/or male die is arranged in the at least one window region of the positioning aid, for the at least one female die and/or male die to be fastened by means of a fastening device in the at least window region. The fastening device is preferably a clamp.

Further, it is useful if the female die and/or male die comprises metals, in particular brass or further copper alloys, and/or plastics, in particular photopolymers.

The female die and/or male die is advantageously designed multi-layered, in particular the female die and/or male die comprises a first layer, preferably a first metal layer, a second layer, preferably a second metal layer, and an adhesive layer. Here, it has been shown that particularly good embossing results can be achieved through such a design of the female die and/or male die.

Preferably, the first layer is a first metal layer, in particular a brass layer, and the second layer is a second metal layer, in particular a steel layer.

Preferably, the first layer is a first metal layer and/or the second layer is a second metal layer, wherein the first and/or second metal layer comprises brass, bronze, copper, nickel, zinc, tin, lead, iron or steel.

The first layer is expediently a first metal layer made of a non-magnetic or weakly magnetic material, in particular of copper and/or zinc. Thus, it is possible for the first layer to be a brass layer.

The second layer is preferably a second metal layer made of ferromagnetic materials, in particular comprising iron, ferrites, cobalt and/or nickel. Thus, it is possible for the second layer to be a steel layer.

Thus, it is possible for the first layer to be a first metal layer made of a non-magnetic or weakly magnetic material and the second layer to be a metal layer made of a magnetic, in particular strongly magnetic, material. For example, the first layer can be a brass layer and the second layer can be a steel layer.

The second layer, in particular the second metal layer, is advantageously magnetic. A simple arrangement of the female die and/or male die on the embossing roller and/or the counter-pressure roller is hereby possible.

It is expedient if the second layer, in particular the second metal layer, of the female die is thicker, is preferably between 1.2 and 3.5 times, further preferably between 1.2 and 2.5 times, thicker than the second layer, in particular the second metal layer, of the male die. It is also possible for the second layer, in particular the second metal layer, of the female die to be at least 0.05 mm, preferably at least 0.1 mm, further preferably at least 0.15 mm, thicker than the second layer, in particular the second metal layer, of the male die.

It can hereby be achieved that the retention force with which the at least one female die is arranged on the embossing roller is higher than the retention force with which the at least one male die is arranged on the counter-pressure roller. With respect to the further advantages of such an embodiment, reference is made here to the above statements.

The female die and the male die preferably contain the same materials and/or have the same layer structure, in particular the female die and the male die, in particular the first layers, are formed of metal, in particular of brass.

Further, it is also possible for the first layer, in particular the first metal layer, of the female die and of the male die to be formed of the same metal, preferably brass. Further, it is useful if the layer of the female die and/or male die having the at least one recess and/or elevation are formed of the same metal, preferably of brass.

Here, it has been shown that high-quality embossing results can hereby be achieved, in particular that fine contours of the relief shapes to be embossed can also be produced in the embossing.

It is also preferred that the female die and male die contain different materials, in particular that the female die contains metal, in particular brass, and the male die contains plastic, in particular a photopolymer, natural rubber or vulcanized rubber.

It is also preferred if the first layers of the female die and of the male die contain different materials. Thus, it is possible for the first layer of the female die to be formed of metal, in particular of brass, and the first layer of the male die to be formed of plastic, in particular of a photopolymer, natural rubber or vulcanized rubber. Further, it is possible for the first layer of the male die to be formed of a vulcanized rubber printing blanket.

It can hereby be achieved that for example the male die and/or the first layer of the male die can be favorably and easily produced from a vulcanized rubber, wherein at the same time a good embossing result is achieved, in particular since the softer male die adapts itself to the relief shape of the harder female die, which is, for example, made of metal.

Preferably, the thickness of the first layer is between 0.5 mm and 2.5 mm, preferably between 0.75 mm and 2 mm, further preferably between 1 mm and 1.75 mm, and/or the thickness of the second layer is between 0.05 mm and 1.5 mm, preferably between 0.1 mm and 1 mm, further preferably between 0.15 mm and 0.5 mm.

Further, it is advantageous if the adhesive layer is a hot-melt adhesive or cold adhesive layer.

Thus, it is also possible for the adhesive layer to be a two-component adhesive (2C adhesive), in particular comprising epoxy resins. The adhesive layer is preferably an epoxy-based 2C adhesive system, such as for example Araldite from Huntsman, Salt Lake City, Utah, USA.

Further, it is also advantageous if the adhesive layer is a double-sided adhesive tape. The double-sided adhesive tape is preferably coated on two sides with a pressure sensitive adhesive (PSA). Such double-sided adhesive tapes can be obtained, for example, from tesa, Norderstedt, Germany.

Further, it is useful if the adhesive layer preferably has a layer thickness between 0.01 mm and 0.75 mm, preferably between 0.05 mm and 0.5 mm, further preferably between 0.05 mm and 0.25 mm.

However, it is also possible for the female die and/or male die to be designed single-layered. The single-layered female die and/or male die is preferably magnetic. The single-layered female die and/or male die is advantageously formed of a magnetic, in particular strongly magnetic, material. The single-layered female die and/or male die preferably comprises ferromagnetic materials, in particular comprising iron, ferrites, cobalt and/or nickel.

Thus, it is possible for the single-layered female die and/or male die to be formed of steel. The female die and/or male die can thus in particular be a single-layered steel female die and/or steel male die.

In the case of a single-layered female die and/or male die, it is also advantageous if the female die is thicker, is preferably between 1.2 and 3.5 times, further preferably between 1.2 and 2.5 times, thicker than the male die. Here too, it is possible for the female die to be at least 0.05 mm, preferably at least 0.1 mm, further preferably at least 0.15 mm, thicker than the male die. With respect to the advantages of such an embodiment, reference is made here to the above statements.

It is also advantageous if the female die has a thickness between 0.1 mm and 5 mm, preferably between 0.5 mm and 3 mm, and/or the male die has a thickness between 0.1 mm and 5 mm, preferably between 0.5 mm and 3 mm.

It is expedient, in particular in the production of the female die and/or male die, for the at least one elevation and/or recess to be engraved and/or milled, in particular by means of a computer-controlled engraving machine and/or a computer-controlled milling machine.

It is also possible for the at least one elevation and/or recess to be produced by photolithography.

Further, it is possible for the at least one elevation and/or recess to be produced by means of a laser, in particular by laser ablation.

Here, it has been shown that, in particular in the production of the female die and/or male die by means of a computer-controlled engraving machine and/or milling machine, female dies and/or male dies can be produced which are characterized by particularly good embossing results, in particular with which fine contours in the form of correspondingly embossed elevations and/or depressions of the substrate can be produced.

Further, it is advantageous, in particular in the production of the female die and/or male die, that the method further comprises the following step, which is performed in particular before the step of producing the at least one elevation and/or recess in the surface of the female die and/or male die: reducing the size of the defined shape of the at least one elevation and/or recess in the surface of the female die and/or male die by a predetermined reduction factor, wherein the reduction factor is in particular between 0.95 and 1, preferably between 0.9750 and 0.9999, further preferably between 0.98000 and 0.99999, still further preferably between 0.99000 and 0.9999. The predetermined reduction factor is advantageously determined as a function of the diameter of the embossing roller and/or of the counter-pressure roller. Further, it is possible for the predetermined reduction factor to be determined as a function of the embossing length and/or of a printing length, in particular on the substrate. Here, it has been shown that the embossing result can be further improved by such a reduction factor, since hereby a possible distortion or elongation of the relief to be embossed in particular due to the curvature of the embossing roller and/or of the counter-pressure roller can in particular be compensated for on the substrate.

Furthermore, it is advantageous if the defined shape of the at least one elevation and/or recess in the surface of the female die and/or male die is distorted according to a predetermined distortion factor, in particular along a surface normal of the plane spanned by the female die and/or male die. Thus, it is possible for the at least one elevation and/or recess to have a distortion, in particular along a surface normal of the plane spanned by the female die and/or male die.

Regions of the at least one female die and/or male die, which are not to emboss the substrate, are preferably removed or cropped. In particular, the male die is removed or cropped here such that the so-called base of the female die is not embossed in the substrate. Here, the male die is preferably removed or cropped by at least 0.2 mm, further preferably by at least 0.3 mm, still further preferably by at least 0.4 mm.

Further preferred embodiments of the method and of the device for rotary blind embossing of a substrate are described, among other things, in the following:

Further, it is possible for the method to further comprise the following step, which is carried out in particular before step a) and/or step b): inserting at least one compensation layer between the at least one female die and the embossing roller and/or the at least one male die and the counter-pressure roller. Thus, it is also possible for at least one compensation layer to be arranged between the at least one female die and the embossing roller and/or the at least one male die and the counter-pressure roller. The height of the female die and/or of the male die can hereby be adapted in a defined manner, in order to make a height leveling possible, for example.

It is also possible for the ratio of the diameter of the embossing roller to the diameter of the counter-pressure roller to be 1 to 2, preferably 1 to 1.

The embossing roller and the counter-pressure roller are preferably driven in opposite directions to each other with corresponding rotational speeds. Thus, it is also possible that the embossing roller and the counter-pressure roller can be driven in opposite directions to each other with corresponding rotational speeds.

Here, the at least one female die and the at least one male die preferably engage with each other on every revolution such that the substrate located between the at least one female die and the at least one male die is embossed, in particular in an overlap region of the at least one female die and the at least one male die. Thus, it is further also possible for the at least one female die and the at least one male die to be arranged such that they engage with each other on every revolution such that the substrate located between the at least one female die and the at least one male die can be embossed, in particular in an overlap region of the at least one female die and the at least one male die.

It is further advantageous that the substrate is embossed such that the deviations between the embossings of each revolution are less than 2% percent, preferably less than 1% percent, still further preferably less than 0.05% percent.

Expediently, the method further comprises the following step: feeding the substrate to the work station comprising the embossing roller and the counter-pressure roller.

Further, it is useful if the method further comprises at least one of the following steps, which are performed in one or more further work stations: printing the substrate; severing the substrate; grooving and/or folding the substrate. Thus, it is also possible for the device to further comprise one or more further work stations for printing the substrate and/or for severing the substrate and/or for grooving and/or folding the substrate. The one or more further work stations are preferably arranged before and/or after the work station comprising the embossing roller and the counter-pressure roller.

The printing here is preferably effected by means of offset printing, screen printing, gravure printing, relief printing or inkjet printing. Further, it is preferred if the print is produced by means of a print roller. During the printing, one or more printing inks are advantageously applied to the substrate, in particular according to a printing grid. The substrate is preferably severed by punching, wherein the substrate is in particular severed by means of a cutting tool and/or punching tool. During the grooving, the bending capacity of the substrate is preferably altered by means of a compression tool, in particular by material displacement. By folding is preferably meant the production of a sharp crease edge with the aid of a tool.

According to a further embodiment example of the invention, the substrate is preferably processed continuously.

It is also advantageous that, in particular in step a), the substrate is provided in sheets.

Further, it is preferred here if the deviations between the embossings on the sheets of the substrate provided in sheets are less than 2% percent, preferably less than 1% percent, still further preferably less than 0.05% percent.

Further, it is possible for more than 8000 sheets per hour, preferably more than 10,000 sheets per hour, further preferably more than 12,000 sheets per hour, still further preferably more than 14,000 sheets per hour, of the substrate provided in sheets to be processed by means of the method and/or the device.

BRIEF DESCRIPTION OF THE DRAWINGS

Embodiment examples of the invention are explained by way of example below with the aid of the attached figures, not to scale.

DETAILED DESCRIPTION OF THE PREFERRED EMBODIMENTS

Figure 1A:
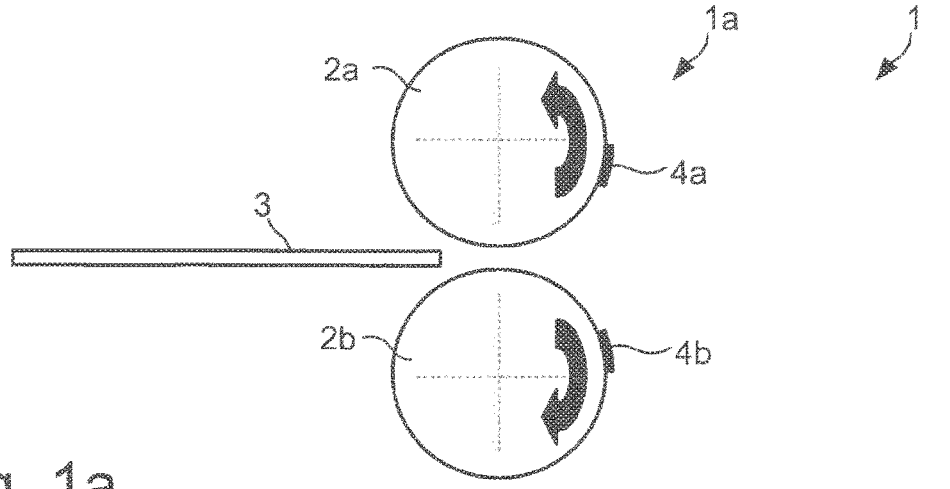
FIG. 1*a* to FIG. 1*c* schematically show a device and a method for rotary blind embossing FIG. 2 schematically shows a device for rotary blind embossing FIG. 3 schematically shows a device for rotary blind embossing FIG. 4 schematically shows a method for rotary blind embossing FIG. 5 schematically shows a device for rotary blind embossing FIG. 6*a* to FIG. 6*d* schematically show sectional representations of embossing rollers and/or counter-pressure rollers FIG. 7*a* to FIG. 7*e* schematically show positioning aids in top view FIG. 7*f* to FIG. 7*i* schematically show sectional representations of the enlarged detail of FIG. 7*c*
Figure 1B:
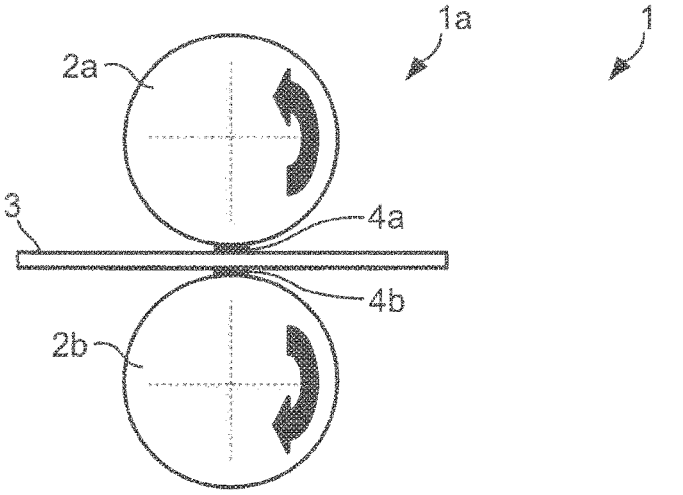
Figure 1C:
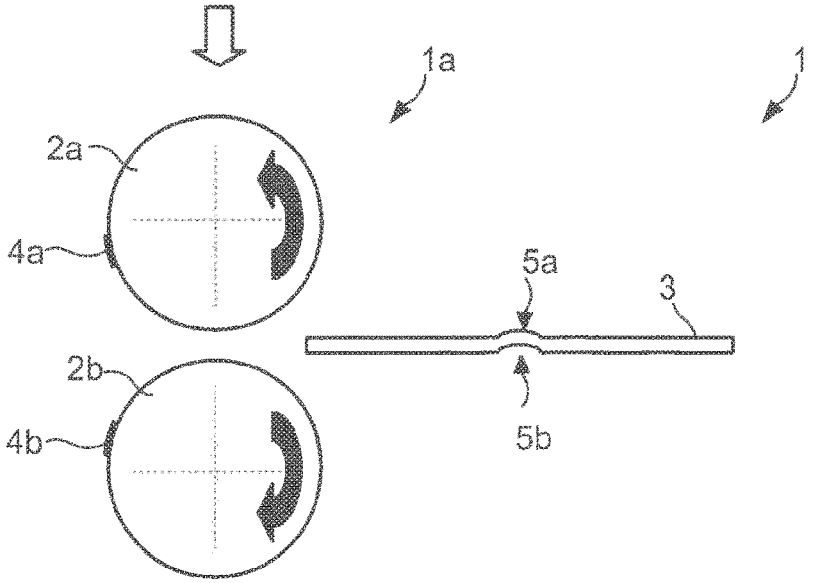

FIG. 1*a* to FIG. 1*c* schematically show a device 1 for rotary blind embossing.

The device 1 for rotary blind embossing of a substrate 3 comprises a work station 1*a* which in turn comprises an embossing roller 2*a* and a counter-pressure roller 2*b*, wherein a female die 4*a* is arranged on the embossing roller 2*a* and a male die 4*b* is arranged on the counter-pressure roller 2*b*.

By blind embossing is meant here in particular a relief embossing without the use of an ink, in particular a printing ink, and/or without the use of a transfer film, in particular a hot-stamping film or cold-stamping film. A pattern, motif or lettering is preferably embossed in the substrate 3, wherein in particular in the case of an embossing the pattern, motif or lettering is raised and/or in the case of a debossing the pattern, motif or lettering is depressed into the substrate 3.

By means of the device 1 shown in FIG. 1*a*, a method for rotary blind embossing of the substrate 3 is carried out in the work station 1*a* comprising an embossing roller 2*a* and a counter-pressure roller 2*b*, as shown in FIG. 1*a* to FIG. 1*c*, wherein the method comprises the following steps, which are performed in particular in the following sequence: a) providing the substrate 3; b) blind embossing the substrate 3 by means of the female die 4*b* arranged on the embossing roller 2*a* and the male die 4*b* arranged on the counter-pressure roller 2*b*.

As shown in FIG. 1*a*, the substrate 3 is provided in a first step. Then, as shown in FIG. 1*b*, the substrate 3 is embossed or blind embossed by means of the female die 4*a* arranged on the embossing roller 2*a* and the male die 4*b* arranged on the counter-pressure roller 2*b*.

As shown in FIG. 1*c*, it is advantageous if, in the step shown in FIG. 1*b*, the substrate 3 is blind embossed such that the substrate 3 has at least one elevation 5*a* and/or depression 5*b*.

By an elevation 5*a* and/or depression 5*b* of the substrate 3 is meant in particular a relief shape which represents a pattern, motif or lettering. An elevation 5*a* of the substrate 3 relative to an unprocessed region of the substrate 3 is preferably an embossing, with the result that the pattern, motif or lettering is raised in the substrate 3. A depression 5*b* of the substrate 3 relative to an unprocessed region of the substrate 3 is preferably a debossing, with the result that the pattern, motif or lettering is depressed into the substrate 3. For example, in the case of a debossing the elevation 5*a* and/or depression 5*b* shown in FIG. 1*c* would be mirrored on the plane spanned by the substrate 3, i.e. the protrusion of the substrate 3 would now point downwards and not upwards.

Further, it is advantageous if the at least one elevation 5*a* and/or depression 5*b* of the substrate 3 is produced with a height and/or depth of at least 0.05 mm, preferably at least 0.1 mm, further preferably at least 0.5 mm.

As shown schematically in FIG. 1*a* to FIG. 1*c*, the ratio of the diameter of the embossing roller 2*a* to the diameter of the counter-pressure roller 2*b* is 1 to 1. However, it is also possible for the embossing roller 2*a* and the counter-pressure roller to have different diameters. Thus, it is also possible for the ratio of the diameter of the embossing roller 2*a* to the diameter of the counter-pressure roller 2*b* to be 1 to 2. Preferably, the diameter of the embossing pressure roller is between 100 mm and 450 mm, preferably between 200 mm and 350 mm, and/or the diameter of the counter-pressure roller is between 200 mm and 800 mm, preferably between 400 mm and 700 mm. Thus, it is possible for the diameter of the embossing roller to be, for example, 300 mm±5 mm, preferably 298.4 mm±0.02 mm, and/or the diameter of the counter-pressure roller to be, for example, 600 mm±5 mm, preferably 599.4 mm±0.02 mm.

As shown in FIG. 1*a* to FIG. 1*c*, the substrate 3 is preferably provided in sheets. However, it is also possible for the substrate 3 to be provided on rolls for roll-to-roll processing.

The substrate 3 preferably comprises pulp and/or plastics. Advantageously, the substrate 3 is paper, cardboard and/or films, in particular plastic films, or hybrid and/or composite materials made of such materials.

Expediently, the substrate 3 is fed to the work station 1*a* comprising the embossing roller 2*a* and the counter-pressure roller 2*b*. This takes place, for example, by means of a transport device which has corresponding rollers with which the substrate 3 is transported to the desired position in the work station 1*a*, i.e. the substrate 3 is correspondingly advanced.

As indicated by the arrows in FIG. 1*a* to FIG. 1*c*, the embossing roller 2*a* and the counter-pressure roller 2*b* are preferably driven in opposite directions to each other with corresponding rotational speeds. Here, the female die 4*a* and the male die 4*b* advantageously engage with each other on every revolution such that the substrate 3 located between the female die 4*a* and the male die 4*b* is embossed, in particular in an overlap region of the female die 4*a* and the male die 4*b*.

By means of the device shown in FIG. 1*a* to FIG. 1*c*, it is possible for the substrate 3 to be embossed such that the deviations between the embossings of each revolution are less than 2% percent, preferably less than 1% percent, still further preferably less than 0.05% percent.

With respect to the arrangement of the female die 4*a* on the embossing roller 2*a* and of the male die 4*b* on the counter-pressure roller 2*b* and the design of the female die 4*a* and of the male die 4*b*, reference is made here to the statements below.

Figure 2:
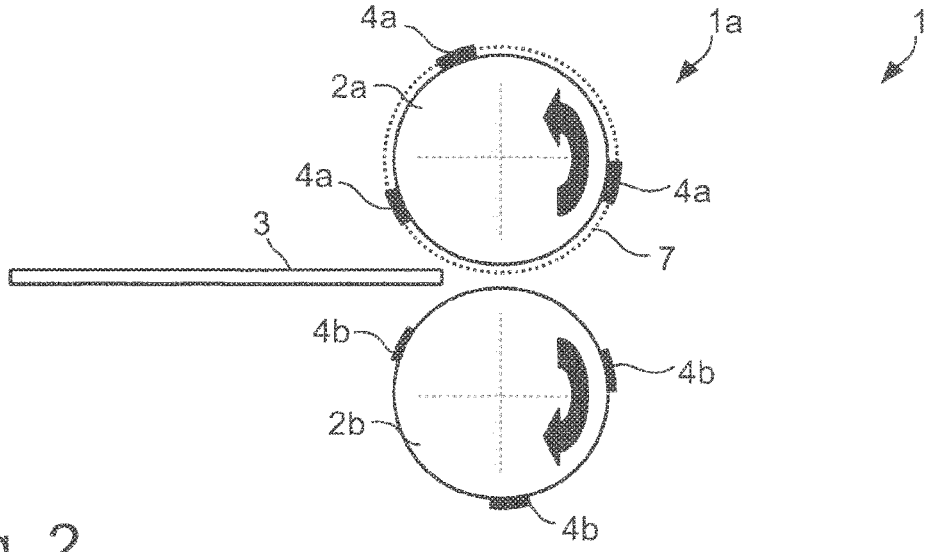

FIG. 2 schematically shows a device 1 for rotary blind embossing. The device of FIG. 2 differs from the device 1 of FIG. 1*a* to FIG. 1*c* in that three female dies 4*a* are arranged on the embossing roller 2*a* and correspondingly three male dies 2*b* are arranged on the counter-pressure roller 2*b*.

Here too, the embossing roller 2*a* and the counter-pressure roller 2*b* are preferably driven in opposite directions to each other with corresponding rotational speeds, wherein the female dies 4*a* and the male dies 4*b* in each case engage with each other on every revolution such that the substrate 3 located between the female dies 4*a* and the male dies 4*b* is embossed, in particular in an overlap region of the female dies 4*a* and the male dies 4*b*.

Further, unlike the device of FIG. 1*a* to FIG. 1*c*, the device 1 of FIG. 2 has a positioning aid 7. In FIG. 2, the positioning aid 7 is only arranged on the embossing roller 2*a*.

Here, in the regions in which the female dies 4*a* are arranged on the embossing roller 2*a*, the positioning aid 7 has apertures in the form of window regions, into which the female dies 4*a* can be inserted. Advantageously, first of all the positioning aid comprising the window regions is therefore provided before the substrate 3 is embossed. Then the positioning aid 7 is arranged on the embossing roller 2*a* and the female dies 4*a* are arranged in the window regions of the positioning aid 7, preferably on the embossing roller 2*a*.

With respect to the further design of the positioning aid 7 and the arrangement of the female die 4*a* on the embossing roller 2*a*, reference is made here to the statements below.

Figure 3:
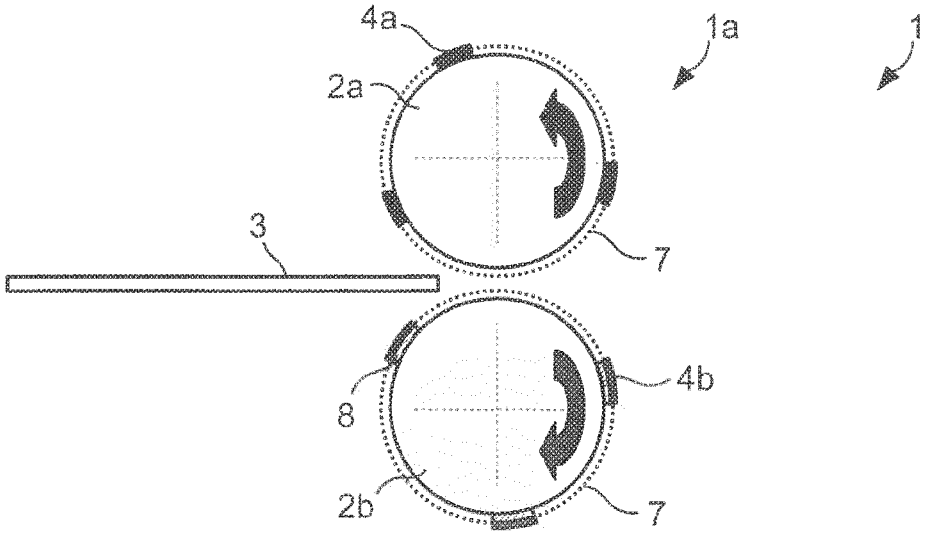

FIG. 3 schematically shows a device 1 for rotary blind embossing. The device of FIG. 3 differs from the device of FIG. 2 in that a positioning aid 7 is arranged both on the embossing roller 2*a* and on the counter-pressure roller 2*b*. Here, in the regions in which the male dies 4*b* are arranged on the counter-pressure roller 2*b*, the positioning aid 7 arranged on the counter-pressure roller also has apertures in the form of window regions, into which the male dies 4*b* can be inserted. Advantageously, first of all the positioning aid comprising the window regions is therefore provided before the substrate 3 is embossed. Then the positioning aid 7 is arranged on the counter-pressure roller 2*b* and the male dies 4*b* are arranged in the window regions of the positioning aid 7, preferably on the counter-pressure roller 2*b*.

With respect to the further design of the positioning aid 7 and the arrangement of the male die 4*b* on the counter-pressure roller 2*b*, reference is made here to the statements below.

Further, unlike the device 1 of FIG. 2, the device 1 of FIG. 3 has compensation layers 8 which are arranged between the male dies 4*b* and the counter-pressure roller 2*b*.

Such compensation layers preferably have a layer thickness of at least 0.01 mm, preferably 0.02 mm, further preferably 0.03 mm.

A defined height leveling of the embossing, i.e. an underlaying, is possible by means of such compensation layers. Further, it is also possible for the compensation layers to be arranged between the female dies 4*a* and the embossing roller 2*a*.

Figure 4:
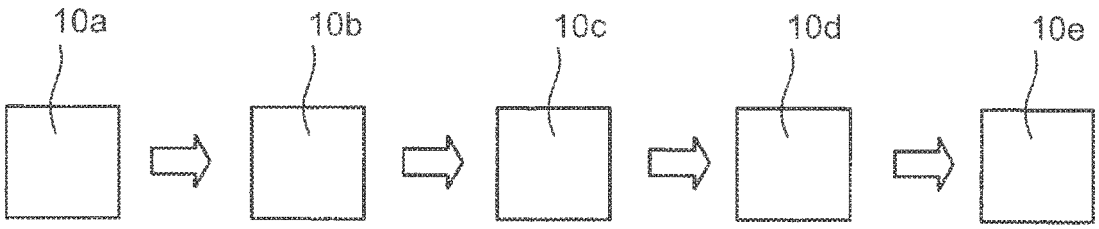

FIG. 4 schematically shows a method for rotary blind embossing. The method comprises the step 10*a* to 10*e*.

In the method, first of all in step 10*a* a substrate 3 is provided.

In a further step 10*b*, the substrate 3 is printed. The printing here is preferably effected by means of offset printing, screen printing, gravure printing, relief printing or inkjet printing. Further, it is preferred if the print is produced by means of a print roller. During the printing, one or more printing inks are advantageously applied to the substrate 3, in particular according to a grid.

In a further step 10*c*, the substrate 3 is blind-embossed by means of a female die 4*a* arranged on an embossing roller 2*a* and a male die 4*b* arranged on a counter-pressure roller 2*b*. With respect to the blind embossing, reference is made here to the above statements. Expediently, here the substrate 3 is fed to the embossing roller 2*a* and the counter-pressure roller 2*b* in a defined, in particular registration-accurate, manner.

By register or registration, or register accuracy or registration accuracy, is meant in particular a positional accuracy of two or more elements and/or layers relative to each other, here for example the positionally accurate arrangement of the embossing and further features applied to the substrate, such as for example a print, layers and/or fold or crease lines applied to the substrate, relative to each other. The register accuracy is in particular to vary within a predefined tolerance, which is to be as small as possible. At the same time, the register accuracy of several elements and/or layers relative to each other is expediently an important feature for increasing the process reliability. The positionally accurate positioning can be effected in particular by means of sensory, preferably optically detectable, registration marks or register marks. These registration marks or register marks can either represent special separate elements or regions or layers or themselves be part of the elements or regions or layers to be positioned.

In a further step 10*d*, the substrate 3 is grooved and/or folded. During the grooving, the bending capacity of the substrate 3 is preferably altered by means of a compression tool, in particular by material displacement. By folding is preferably meant the production of a sharp crease edge with the aid of a tool.

In a further step 10*e*, the substrate 3 is severed. The substrate 3 is preferably severed by punching, wherein the substrate 3 is in particular severed by means of a cutting tool and/or punching tool.

Steps 10*a* to 10*e* are preferably carried out in different work stations of a device.

Here, it is useful if the substrate 3 is preferably processed continuously.

It is also advantageous if the substrate 3 is provided in sheets. Further, it is preferred here if the deviations between the embossings on the sheets of the substrate 3 provided in sheets are less than 2% percent, preferably less than 1% percent, still further preferably less than 0.05% percent.

Further, it is possible for more than 8000 sheets per hour, preferably more than 10,000 sheets per hour, further preferably more than 12,000 sheets per hour, still further preferably more than 14,000 sheets per hour, of the substrate 3 provided in sheets to be processed by means of the method.

Figure 5:
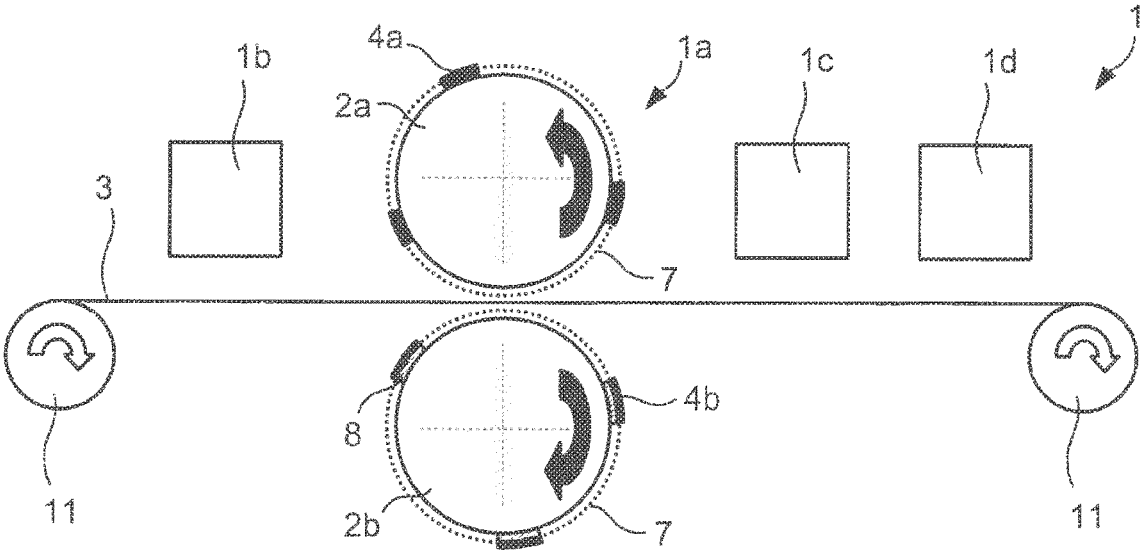

FIG. 5 schematically shows a device 1 for rotary blind embossing.

The device 1 in FIG. 5 comprises a transport device 11, which serves to transport the substrate 3. Thus, it is possible for example for the transport device 11 to comprise a supply roll, on which the substrate 3 is wound. Alternatively, it is also possible for the transport direction 11 to be designed for transporting substrate 3 in sheet form.

Further, the device 1 comprises the work station 1*b* for printing the substrate 3. The work station preferably comprises a print roller. With respect to the printing of the substrate 3, reference is made here to the above statements.

Further, the device 1 comprises the work station 1*a* for rotary blind embossing of the substrate 3. With respect to the design of the work station 1*a* and the rotary blind embossing, reference is also made here to the above statements.

Further, the device comprises the work station 1*c* for grooving and/or folding the substrate 3. The work station 1*c* preferably comprises a compression tool and/or folding tool for producing a sharp crease edge. With respect to the grooving and/or folding of the substrate 3, reference is also made here to the above statements.

Further, the device comprises the work station 1*d* for severing the substrate 3. The work station 1*d* advantageously comprises a cutting tool. With respect to the severing of the substrate 3, reference is also made here to the above statements.

As shown in FIG. 5, the work station 1*b* is arranged before the work station 1*a* comprising the embossing roller 2*a* and the counter-pressure roller 2*b*. The work stations 1*c* and 1*d* are arranged after the work station 1*a* comprising the embossing roller 2*a* and the counter-pressure roller 2*b*. However, other sequences of the work stations are also conceivable. Thus, it is possible for example for the work station 1*c* to be arranged before and/or for the work station 1*b* to be arranged after the work station 1*a* comprising the embossing roller 2*a* and the counter-pressure roller 2*b*.

Further, it is advantageous if more than 8000 sheets per hour, preferably more than 10,000 sheets per hour, further preferably more than 12,000 sheets per hour, still further preferably more than 14,000 sheets per hour, of the substrate 3 provided in sheets are processed by means of the device 1.

FIG. 6*a* to FIG. 6*d* schematically show sectional representations of embossing rollers 2*a* and/or counter-pressure rollers 2*b*.

Figure 6A:
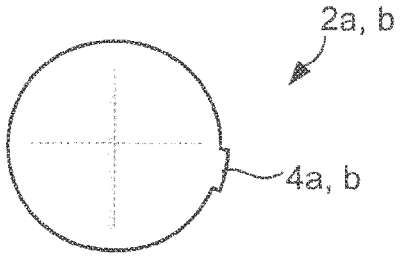

As shown in FIG. 6*a*, it is possible for the female die 4*a* to be introduced directly as at least one elevation and/or recess into the surface of the embossing roller 2*b* and/or for the at least one male die 4*a* to be introduced directly as at least one elevation and/or recess into the surface of the counter-pressure roller 2*b*. The female die 4*a* and/or the male die 4*b* can thus be in particular a solid tool, which is designed in particular completely solid in one piece or partially solid in one piece at least in the region of the embossing tools. In the case of such solid tools, the relief shapes to be embossed are therefore introduced directly into the surface of the solid cylinder forming the embossing roller 2*a* and/or counter-pressure roller 2*b*. The introduction is preferably effected by etching, engraving and/or by means of a laser, in particular by means of laser ablation.

Figure 6B:
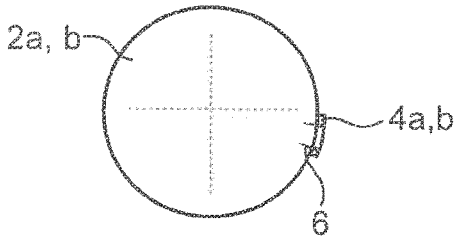

Further, it is also possible, as shown in FIG. 6*b*, for the female die 4*a* and/or the male die 4*b* to be fixed on the embossing roller 2*a* and/or the counter-pressure roller 2*b* by means of a fixing device 6. The fixing device 6 is preferably a pin, bolt or a screw. Further, it is advantageous if the embossing roller 2*a* and/or the counter-pressure roller 2*b* has a plurality of holes into which the fixing device 6 can be introduced. It can hereby be achieved that the female die 4*a* and/or male die 4*b* can be fixed at points predefined by the plurality of holes. However, the fixing can also be effected by a clamp. Further, it is possible for the female die 4*a* and/or the male die 4*b* to be fixed on the embossing roller 2*a* and/or the counter-pressure roller 2*b* by clamping or tensioning.

Further, it is possible for the embossing roller 2*a* and/or the counter-pressure roller 2*b* to be magnetic or to be formed magnetic. It is also possible for the embossing roller 2*a* and/or the counter-pressure roller 2*b* to be a magnetic cylinder. Here, the female die 4*a* and/or the male die 4*b* can preferably be fixed on the embossing roller 2*a* and/or counter-pressure roller 2*b* magnetically.

Figure 6C:
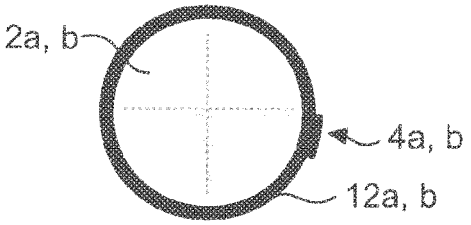

As shown in FIG. 6*c*, it is also possible for the female die 4*a* to be introduced as an elevation and/or recess into the surface of an embossing cylinder 12*a* which is arranged detachably on the embossing roller 2*a* and/or for the male die 4*b* to be introduced as an elevation and/or recess into the surface of a counter-pressure cylinder 12*b* which is arranged detachably on the counter-pressure roller 2*b*.

It is also possible here for the embossing cylinder 12*a* and/or the counter-pressure cylinder 12*b* to be clamped and/or tensioned onto the embossing roller 2*a* and/or the counter-pressure roller 2*b*. The embossing cylinder 12*a* and/or the counter-pressure cylinder 12*b* is preferably applied to the embossing roller 2*a* and/or the counter-pressure roller 2*b* magnetically, wherein in particular the embossing roller 2*a* and/or the counter-pressure roller 2*b* is magnetic. Alternatively, the embossing cylinder 12*a* and/or the counter-pressure cylinder 12*b* can also be designed magnetic.

Figure 6D:
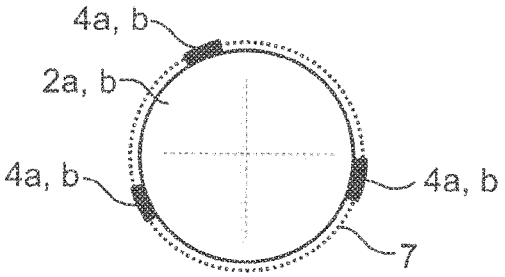

As shown in FIG. 6*d*, it is advantageous if the female die 4*a* and/or the male die 4*b* are arranged on the embossing roller 2*a* and/or the counter-pressure roller 2*b* with the aid of a positioning aid 7. As shown in FIG. 6*d*, several female dies 4*a* and/or male dies 4*b* can in particular be arranged on the embossing roller 2*a* and/or the counter-pressure roller 2*b* or applied to the embossing roller 2*a* and/or the counter-pressure roller with the aid of the positioning aid 7.

Here, in the regions in which the female dies 4*a* and/or male dies 4*b* are arranged on the embossing roller 2*a* and/or the counter-pressure roller, the positioning aid 7 has apertures in the form of window regions, into which the female dies 4*a* and/male dies 4*b* can be inserted. Advantageously, the device thus has a positioning aid 7 with window regions, wherein the positioning aid 7 is arranged on the embossing roller 2*a* and/or the counter-pressure roller 2*b* and the female dies 4*a* and/or male dies 4*b* is arranged in the window regions of the positioning aid.

Preferably, the positioning aid 7 is clamped onto the embossing roller 2*a* and/or the counter-pressure roller 2*b*, in particular the positioning aid 7 is clamped onto the embossing roller 2*a* and/or the counter-pressure roller 2*b* such that the positioning aid 7 has a curvature which substantially corresponds to the diameter of the embossing roller 2*a* and/or the diameter of the counter-pressure roller 2*b*.

By curvature is preferably meant here a radius of curvature, wherein the radius of curvature corresponds in particular to the radius of an osculating circle, which at a particular point of a curve is the circle which best approximates the curve at this point. Thus, for example, the diameter of the embossing roller 2*a* and/or of the counter-pressure roller 2*b* represents an osculating circle, the radius of which is then substantially the radius of curvature of the positioning aid 7.

As shown in FIG. 6*d*, the positioning aid 7 preferably encompasses the embossing roller 2*a* and/or the counter-pressure roller 2*b* completely. However, it is also possible for the positioning aid 7 to encompass the embossing roller 2*a* and/or the counter-pressure roller 2*b* only partially. For example, it is possible for the positioning aid 7 to encompass half of the embossing roller 2*a* and/or the counter-pressure roller 2*b*, with the result that the positioning aid 7 would form a semicircle in FIG. 6*d*. Other partial encompassing, such as for example in the form of a three-quarter circle or a quarter circle, is further conceivable.

It is also possible for the embossing roller 2*a* and/or the counter-pressure roller 2*b* to have several positioning aids 7, which encompass the embossing roller 2*a* and/or the counter-pressure roller 2*b* completely or only partially. For example, two positioning aids 7 can in each case encompass half of the embossing roller 2*a* and/or the counter-pressure roller 2*b*. However, any other subdivisions and/or distributions of several positioning aids 7 on the embossing roller 2*a* and/or the counter-pressure roller 2*b* are also feasible.

Preferably, the positioning aid 7 and/or the embossing roller 2*a* and/or the counter-pressure roller 2*b* has a clamping device, by means of which the positioning aid 7 can in particular be clamped onto the embossing roller 2*a* and/or the counter-pressure roller 2*b*. The clamping device of the positioning aid expediently has holes, by means of which the positioning aid can be fastened on the embossing roller and/or the counter-pressure roller, for example by means of pins or screws.

Here too, it is expedient, in particular for arranging the positioning aid 7 on the embossing roller 2*a* and/or the counter-pressure roller 2*b*, if the embossing roller 2*a* and/or the counter-pressure roller 2*b* is magnetic or is formed magnetic, in particular if the embossing roller 2*a* and/or the counter-pressure roller 2*b* is a magnetic cylinder. The positioning aid 7 can hereby be arranged magnetically on the embossing roller 2*a* and/or the counter-pressure roller 2*b*. Further, it is also possible for the positioning aid 7 itself to be magnetic.

FIG. 7*a* to FIG. 7*e* schematically show positioning aids 7 in top view.

Figure 7A:
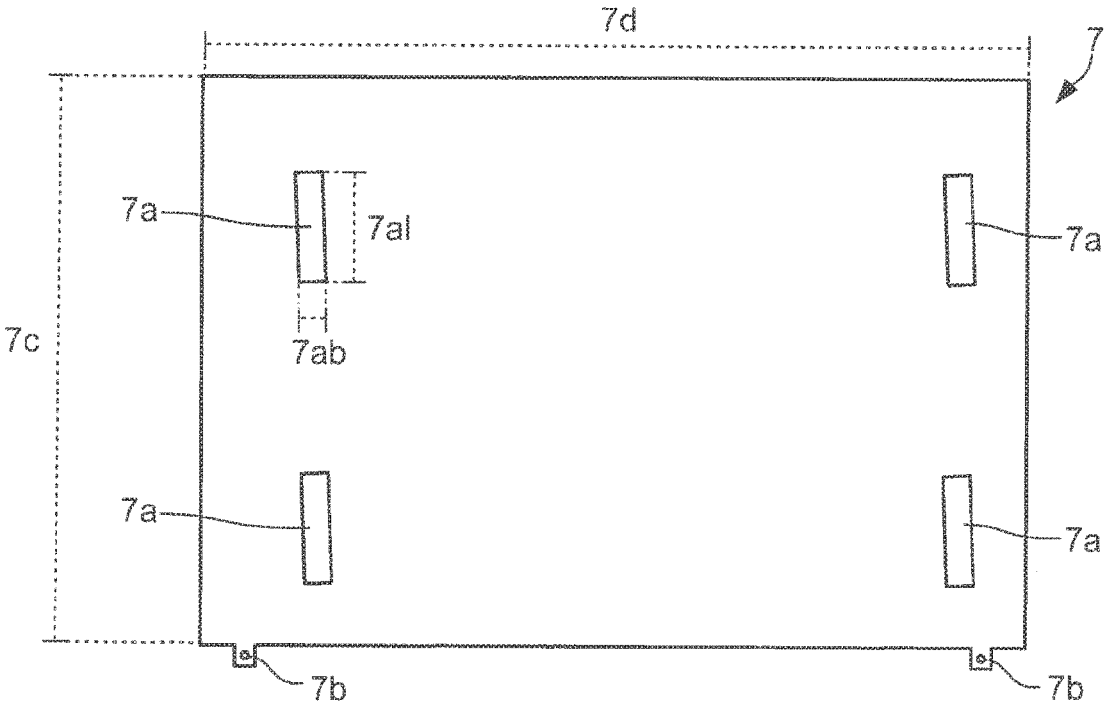

As shown in FIG. 7*a*, the positioning aid preferably has several window regions 7*a*, wherein the several window regions 7*a* are arranged according to a grid.

By region is meant here in particular in each case a defined surface area which is occupied when viewed perpendicular to a plane spanned by the positioning aid 7. Thus, for example, the positioning aid 7, in particular in the flat state, has one or more window regions 7*a*, wherein each of the window regions 7*a* in each case occupies a defined surface area when viewed perpendicular to a plane spanned by the positioning aid 7.

Furthermore, it is possible for the positioning aid 7 to have a width 7*c* of at least 250 mm, preferably of at least 500 mm, further preferably of at least 750 mm, and a length 7*d* of at least 500 mm, preferably at least 750 mm, further preferably of at least 1000 mm, and/or for the at least one window region 7*a* to have a width 7*ab* of at least 5 mm, preferably at least 10 mm, further preferably of at least 20 mm, and a length 7*al* of at least 10 mm, preferably at least 20 mm, further preferably of at least 100 mm.

The positioning aid 7 shown in FIG. 7*a* has, for example, a width 7*c* of 752 mm and a length 7*d* of 1020 mm. Further, the window regions 7*a* of the positioning aid 7 shown in FIG. 7*a* have a width 7*ab* of 40 mm and a length 7*al* of 150 mm. Further, the window regions 7*a* of the positioning aid 7 shown in FIG. 7*a* are turned with respect to the outer edges of the positioning aid 7, in particular by less than 2°, preferably by less than 1°. However, it is also possible for the window regions 7*a* not to be turned with respect to the outer edges of the positioning aid 7.

The positioning aid 7 preferably comprises metals, in particular copper, nickel, chromium, iron, zinc, tin, lead or alloys of such metals. The positioning aid 7 shown in FIG. 7*a* is a positioning aid 7 made of steel.

Further, it is also possible for the positioning aid 7 to be magnetic or to be formed magnetic.

Further, the positioning aid 7 shown in FIG. 7*a* has a clamping device 7*b*. Expediently, the clamping device 7*b* of the positioning aid 7*a* has holes, by means of which the positioning aid 7*a* can be fastened or clamped on the embossing roller 2*a* and/or the counter-pressure roller 2*b*, for example by means of pins or screws.

Figure 7B:
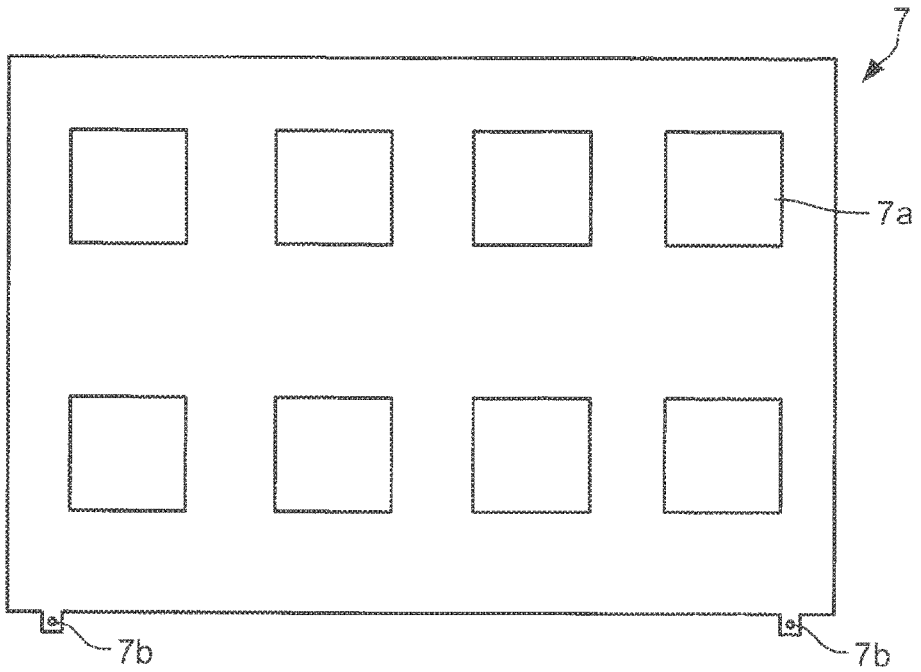

The positioning aid 7 shown in FIG. 7*b* corresponds to the positioning aid 7 shown in FIG. 7*a* with the difference that the window regions 7*a* of the positioning aid shown in FIG. 7*b* are designed square. Further, the window regions 7*a* are not turned with respect to the outer edges of the positioning aid 7. With respect to the further design of the positioning aid 7, reference is made here to the above statements.

Figure 7C:
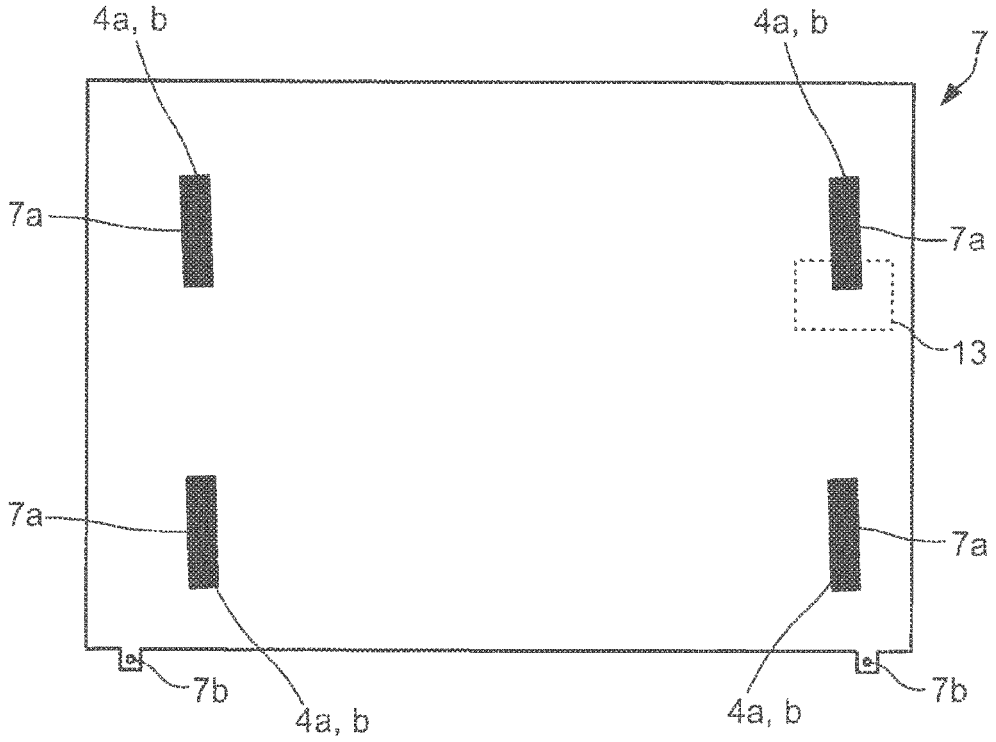

The positioning aid 7 shown in FIG. 7*c* corresponds to the positioning aid 7 shown in FIG. 7*a* with the difference that female dies 4*a* and/or male dies 4*b* are arranged in the window regions 7*a*, wherein female dies 4*a* are used in particular when the positioning aid 7 is arranged on the embossing roller 2*a* and male dies 4*b* are used in particular when the positioning aid 7 is arranged on the counter-pressure roller 2*b*.

As shown in FIG. 7*c*, it is expedient if the outline of the respective window region 7*a* of the positioning aid 7 substantially corresponds to the outline of the female die 4*a* and/or male die 4*b* arranged therein.

By outline is meant here in particular the contours or outer contours of the window region 7*a* or of the male die 4*a* and/or female die 4*b*, which are occupied when viewed perpendicular to a plane spanned by the positioning aid 7 or the female die 4*a* and/or male die 4*b*.

With respect to the detail 13 shown in FIG. 7*c*, reference is made here to the statements below.

Figure 7D:
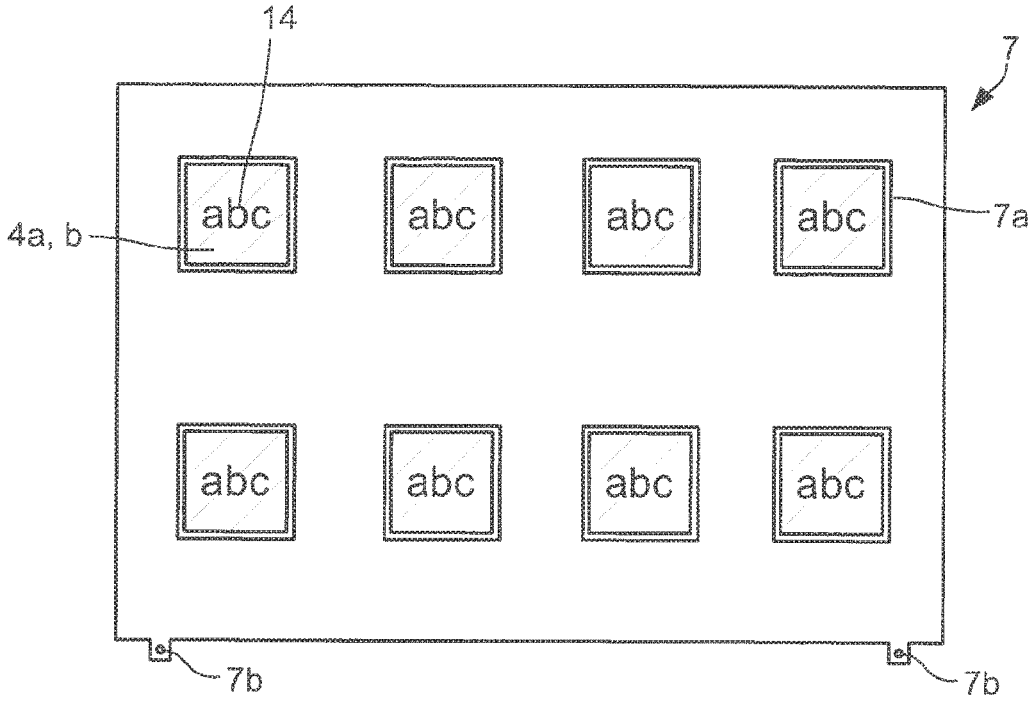

The positioning aid 7 shown in FIG. 7*d* corresponds to the positioning aid 7 shown in FIG. 7*b* with the difference that female dies 4*a* and/or male dies 4*b* are arranged in the window regions 7*a*, wherein the elevations and/or recesses which correspond in particular, in positive and/or negative form, to the relief shapes to be embossed are represented schematically in FIG. 7*d* as lettering. However, it is also possible to use different lettering as relief shapes to be embossed. Patterns or motifs can also be used as relief shapes to be embossed, or combinations of patterns, motifs or lettering.

Figure 7E:
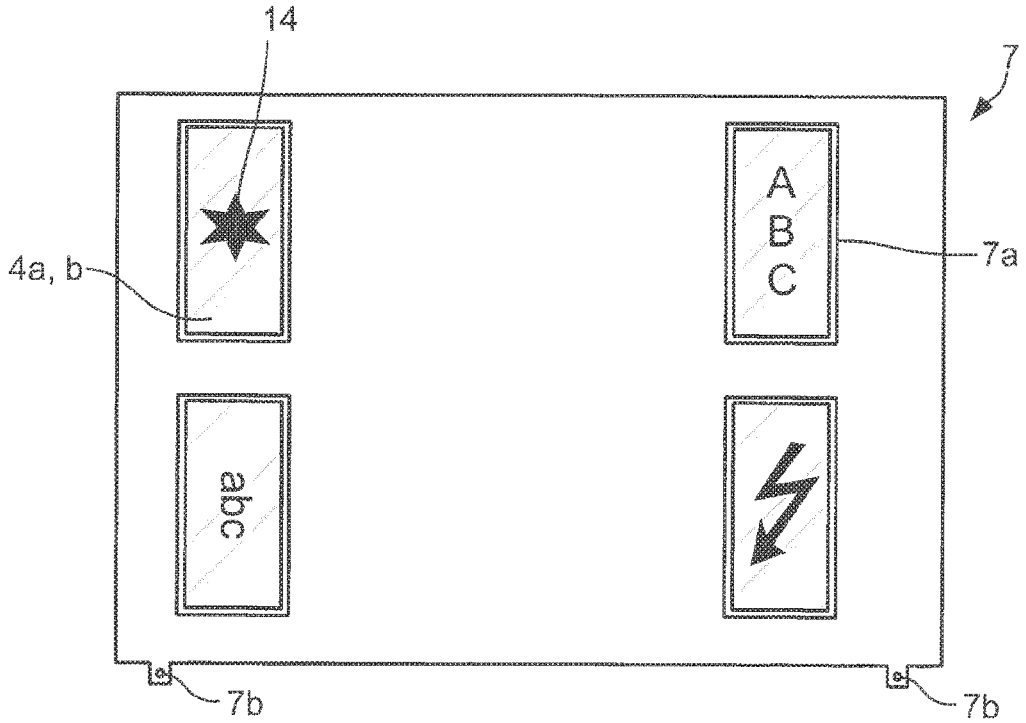

The positioning aid 7 shown in FIG. 7*e* comprises the window regions 7*a*, in which differently designed female dies 4*a* and/or male dies 4*b* are arranged. As shown in FIG. 7*e*, the relief shapes to be embossed can be chosen from a plurality of shapes here. Thus, it is possible for the elevations and/or recesses which correspond in particular, in positive and/or negative form, to the relief shapes to be embossed to represent a pattern, motif or lettering. A pattern can be, for example, a graphically designed outline, a figurative representation, an image, a symbol, a logo, a portrait and the like. Lettering can be, for example, an alphanumeric character, a text and the like. Further, combinations of these patterns, motifs and lettering can also be used as relief shape to be embossed.

FIG. 7*f* to FIG. 7*i* schematically show a sectional representation of the enlarged detail of FIG. 7*c*.

Figure 7F:
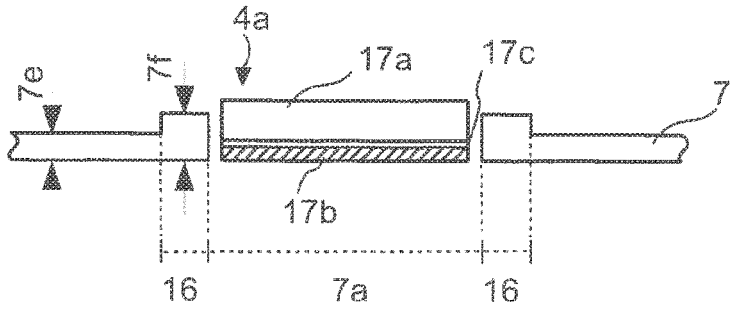

As shown in FIG. 7*f*, the positioning aid 7 preferably has a thickness 7*e* of at least 0.25 mm, preferably of at least 0.5 mm, further preferably of at least 0.75 mm. The positioning aid 7 shown in FIG. 7*f* has a thickness 7*e* of 0.25 mm here.

The positioning aid 7, as shown in FIG. 7*f*, also preferably has a thickness 7*f* that is increased compared with the remaining thickness of the positioning aid 7 in a region 16 around the window region 7*a*. In particular, the positioning aid 7 has a thickness that is increased by at least 0.1 mm, preferably by at least 0.2 mm, compared with the remaining thickness of the positioning aid 7 in the region 16 around the window region 7*a*. The positioning aid 7 shown in FIG. 7*f* has, for example, a thickness 7*f* of 0.5 mm in the region 16.

Further, it is possible for the region 16 around the window region 7*a* to have a width of at least 0.2 mm, preferably of at least 0.5 mm, further preferably of at least 1.5 mm. Thus, the region 16 around the window region 7*a* in FIG. 7*f* has a width of 1.5 mm.

Further, a female die 4*a* is arranged in the window region 7*a*, as shown in FIG. 7*f*. The female die 4*a* comprises the layers 17*a*, 17*b* and 17*c* here. With respect to the layers 17*a*, 17*b* and 17*c* and the design of the female die 4*a*, reference is made here to the statements below.

Further, the window region 7*a* of the positioning aid 7 is expediently larger than the female die 4*a* and/or male die 4*b* arranged in the window region 7*a*. Preferably, the distance from each edge of the window region 7*a* to the female die 4*a* and/or male die 4*b* is at least 0.1 mm, preferably 0.2 mm, still further preferably 0.3 mm.

Figure 7G:
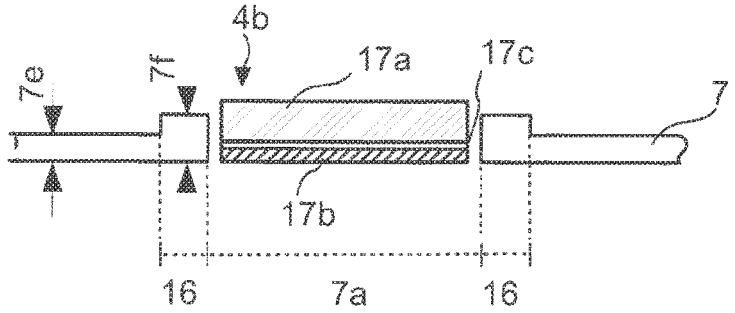

FIG. 7*g* corresponds to FIG. 7*f* with the difference that a male die 4*b* is arranged in the window region 7*a* instead of a female die 4*a*. The male die 4*b* comprises the layers 17*a*, 17*b* and 17*c* here. With respect to the layers 17*a*, 17*b* and 17*c* and the design of the male die 4*b*, reference is made here to the statements below.

Figure 7H:
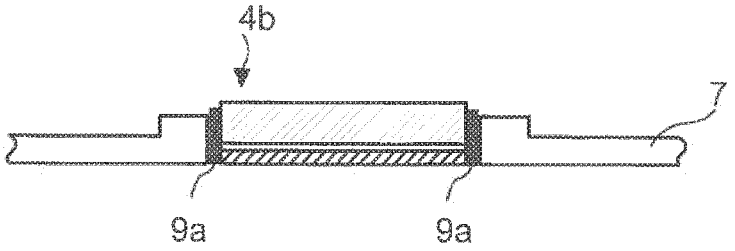

FIG. 7*h* corresponds to FIG. 7*f* with the difference that the male die 4*b* can be adjusted by means of an adjusting aid 9*a* in the window region 7*a* of the positioning aid 7.

Expediently, the adjusting aid 9*a* consists, for example, of one or more plates, in particular of one or more gauge blocks and/or one or more feeler gauges, which are in particular inserted into the gap between male die 4*b* and the edge of the window region 7*a*. Because the window region 7*a* is preferably larger than the male die 4*b*, the gap is formed, into which the adjusting aid 9*a* is preferably introduced. In particular, the gap corresponds to the distance from each edge of the window region 7*a* of the male die 4*b*. Further, it is also possible that the female die 4*a* of FIG. 7*f* can be adjusted by means of an adjusting aid 9*a* in the window region 7*a* of the positioning aid 7.

The adjusting aid 9*a* is preferably arranged such that the at least one female die 4*a* and/or male die 4*b* is arranged movable, in particular flexible, at least in one direction. The adjusting aid 9*a* is advantageously arranged such that the female die 4*a* and/or male die 4*b* is arranged movable, in particular flexible, in a direction parallel to the feed direction of the substrate 3. However, it is also possible for the adjusting aid 9*a* to be arranged such that the at least one female die 4*a* and/or male die 4*b* is arranged movable, in particular flexible, in a direction perpendicular to the feed direction of the substrate 3. The at least one female die 4*a* and/or male die 4*b* is preferably arranged movable, in particular flexible, in a gap which corresponds to the distance from each edge of the at least one window region 7*a* to the at least one female die 4*a* and/or male die 4*b*.

Thus, it is possible for the adjusting aid 9*a* to be arranged on one or two, in particular two opposite sides of the window region 7*a*. For example, the adjusting aid 9*a* is arranged on the sides of the window region 7*a* which run parallel to the longitudinal axis or to the transverse axis of the positioning aid 7.

The adjusting aid 9*a* is preferably arranged on the sides of the window region 7*a* that are parallel to the rotational direction or rolling direction of the embossing roller 2*a* and/or counter-pressure roller 2*b*. However, it is also possible for the adjusting aid 9*a* to be arranged on the sides of the window region 7*a* that are perpendicular to the rotational direction or rolling direction of the embossing roller 2*a* and/or counter-pressure roller 2*b*.

By means of the adjusting aid, the position of the female die 4*a* and/or of the male die within the respective window region 7*a* can thus preferably be defined precisely and the degrees of freedom of the female die 4*a* and/or of the male die 4*b* for the self-adjustment described above can thus preferably be defined.

Figure 7I:
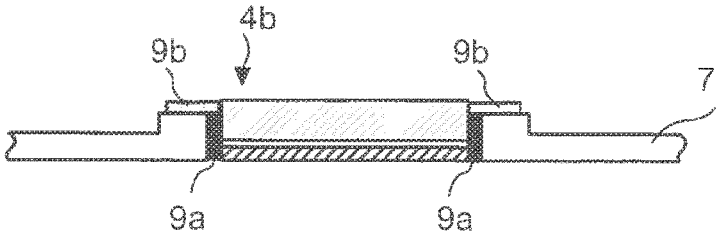

FIG. 7*i* corresponds to FIG. 7*h* with the difference that the male die 4*b* is fastened by means of a fastening device 9*b* in the window region 7*a* of the positioning aid 7. The fastening device 9*a* is preferably a clamp. Further, it is also possible for the female die 4*a* of FIG. 7*f* to be fastened by means of a fastening device 9*b* in the window region 7*a* of the positioning aid 7.

The embossing roller 2*a* and/or the counter-pressure roller 2*b* is arranged underneath the positioning aid 7 and the female die 4*a* and/or male die 4*b*, which is not represented in FIG. 7*f* to FIG. 7*i*. In particular, the female die 4*a* and/or male die 4*b* is therefore applied to the surface of the embossing roller 2*a* and/or of the counter-pressure roller 2*b* in the window region 7*a* of the positioning aid 7. Preferably, the female die 4*a* and the embossing roller 2*a* and/or the male die 4*b* and the counter-pressure roller 2*b* in each case represent two different components of the device, with the result that in particular a quick and easy setup and/or change of the setup of the device can be achieved, since only the female die 4*a* and/or male die 4*b*, which are small compared with the embossing roller 2*a* and/or the counter-pressure roller 2*b*, have to be changed.

Advantageously, the female die 4*a* is magnetically attached to the embossing roller 2*a* and/or the male die 4*b* is magnetically attached to the counter-pressure roller 2*b*, with the result that in particular the easy and quick setup and/or change of the setup can be further improved.

Preferably, the female die 4*a* is arranged on the embossing roller 2*a* and the male die 4*b* is arranged on the counter-pressure roller 2*b* such that the retention force with which the female die 4*a* is arranged on the embossing roller 2*a* is higher, is preferably 1.5 to 5 times higher, is further preferably 2.5 to 3.5 times higher, than the retention force with which the male die 4*a* is arranged on the counter-pressure roller 2*b*.

It is hereby achieved that the male die 4*a* is arranged less firmly compared with the female die 4*b*. The male die 4*b* is thus arranged in particular "more loosely" than the female die 4*a*. Here, it has been shown that embossings that are comparable in terms of quality in particular with the vertical stamping method can nevertheless be achieved by means of such a relatively lower retention force of the male die 4*b* on the counter-pressure roller 2*b* compared with the female die 4*a* on the embossing roller 2*a*, since the male die 4*b* in particular has degrees of freedom due to the lower retention force such that it can occupy the ideal position in relation to the female die 4*a* forming the counterpart. As described above, the degrees of freedom can preferably be restricted and/or released by means of the adjusting aid 9*a*.

Figure 8A:
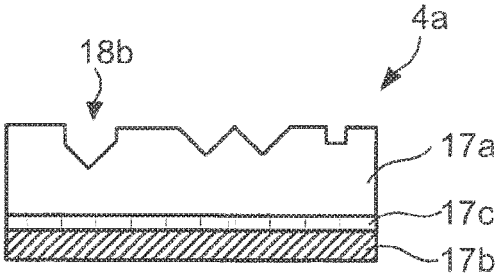
FIG. 8*a* to FIG. 8*c* schematically show sectional representations of female dies and/or male dies FIG. 9*a* and FIG. 9*b* schematically show sectional representations of female dies and/or male dies FIG. 10*a* to FIG. 10*g* schematically show sectional representations of relief shapes FIG. 11*a* to FIG. 11*e* schematically show sectional representations of relief shapes FIG. 12*a* to FIG. 12*d* schematically show sectional representations of relief shapes
Figure 8B:
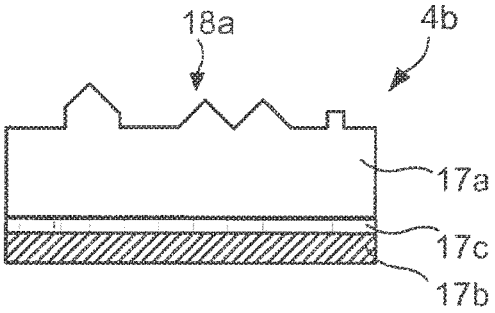
Figure 8C:
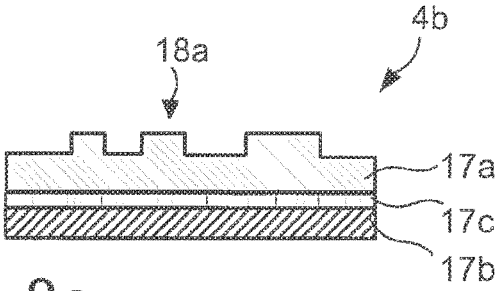

FIG. 8*a* to FIG. 8*c* schematically show sectional representations of female dies 4*a* and/or male dies 4*b*.

Figure 9A:
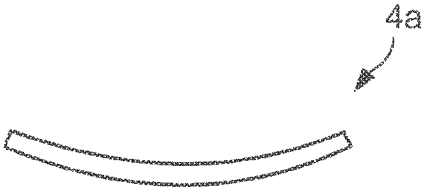
Figure 9B:
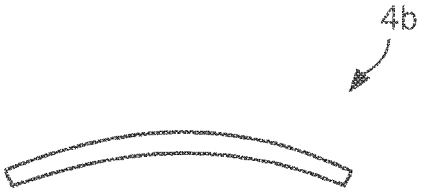

The female die 4*a* shown in FIG. 8*a* and the male die 9*b* shown in FIG. 9*b*, are advantageously designed multi-layered. Thus, the female die 4*a* and the male die 4*b* in particular comprise the layers 17*a* and 17*b* as well as the adhesive layer 17*c*.

Here, the layer 17*a* has the elevations 18*a* and/or recesses 18*b* which correspond in particular, in positive and/or negative form, to the relief shapes to be embossed. Further, it is possible for the elevations and/or recesses to represent a pattern, motif or lettering. A pattern can be, for example, a graphically designed outline, a figurative representation, an image, a symbol, a logo, a portrait and the like. Lettering can be, for example, an alphanumeric character, a text and the like. With respect to the different relief shapes that are to be embossed or can be embossed, reference is made here to the statements below.

Further, it is advantageous if the elevations 18*a* have a height of at most 5.0 mm, preferably of at most 3.0 mm, further preferably of at most 1.0 mm, still further preferably of at most 0.5 mm, and/or if the recesses of the male die have a depth of at most 5.0 mm, preferably of at most 3.0 mm, further preferably of at most 1.0 mm, still further preferably of at most 0.5 mm.

The layer 17*a* is preferably a metal layer of brass, bronze, copper, nickel, zinc, tin, lead, iron or steel. The metal layer 17*a* shown in FIG. 8*a* and FIG. 8*b* is a layer of brass.

The layer 17*b* is preferably a metal layer of ferromagnetic materials, in particular comprising iron, ferrites, cobalt or nickel. Further, it is possible for the layer 17*b* to be a steel layer. The layer 17*b* shown in FIG. 8*a* and FIG. 8*b* is a layer of steel.

Preferably, the layer 17*a* is a metal layer of a non-magnetic or weakly magnetic material and the layer 17*b* is a metal layer of a magnetic, in particular strongly magnetic, material. Thus, it is possible for the layer 17*a* to be a brass layer and for the layer 17*b* to be a steel layer. Advantageously, the layer 17*b* is in particular magnetic.

Preferably, the thickness of the layer 17*a* is between 0.5 mm and 2.5 mm, preferably between 0.75 mm and 2 mm, further preferably between 1 mm and 1.75 mm.

Advantageously, the thickness of the layer 17*b* is between 0.05 mm and 1.5 mm, preferably between 0.1 mm and 1 mm, further preferably between 0.15 mm and 0.5 mm.

In the case of the female die 4*a* shown in FIG. 8*a*, the thickness of the layer 17*a* is, for example, 0.5 mm and the thickness of the layer 17*b* is, for example, 0.25 mm. In the case of the male die shown in FIG. 8*b*, the thickness of the layer 17*a* is, for example, 0.8 mm and the thickness of the layer 17*b* is, for example, 0.15 mm.

The layers 17*a* and 17*b* are, as shown in FIG. 8*a* and FIG. 8*b*, preferably firmly joined by means of an adhesive layer 17*c*. The adhesive layer 17*c* is advantageously a hot-melt adhesive or cold adhesive layer. Thus, it is possible for the adhesive layer 17*c* to be a two-component adhesive (2C adhesive), in particular comprising epoxy resins. Expediently, the adhesive layer 17*c* is an epoxy-based 2C adhesive system, such as for example Araldite from Huntsman, Salt Lake City, Utah, USA.

The adhesive layer 17*c* is preferably a double-sided adhesive tape, which is coated in particular on two sides with a pressure sensitive adhesive (PSA). Such double-sided adhesive tapes can be obtained, for example, from tesa, Norderstedt, Germany.

Further, the adhesive layer 17*c* preferably has a layer thickness between 0.01 mm and 0.75 mm, preferably between 0.05 mm and 0.5 mm, further preferably between 0.05 mm and 0.25 mm. In the case of the female die 4*a* shown in FIG. 8*a*, the thickness of the adhesive layer 17*c* is, for example, 0.05 mm, and in the case of the male die 4*b* shown in FIG. 8*b*, the thickness of the adhesive layer 17*c* is, for example, also 0.05 mm.

The female die 4*a* and the male die 4*b* preferably contain the same materials and/or have the same layer structure, in particular the female die 4*a* and the male die 4*b*, in particular the layers of the female die 4*a* and of the male die 4*b* having the elevations 18*a* and/or recesses 18*b* which correspond in particular, in positive and/or negative form, to the relief shapes to be embossed, are formed of metal, in particular of brass. Thus, it also possible for the layer 17*a* of the female die 4*a* and of the male die 4*b* to be formed of the same metal, preferably brass.

It is expedient if the layer 17*b*, in particular the steel layer, of the female die 4*a* is thicker, is preferably 1.2 to 3.5 times, further preferably 1.2 to 2.5 times, thicker than the layer 17*b*, in particular steel layer, of the male die 4*b*. It is also possible for the layer 17*b*, in particular the steel layer, of the female die 4*a* to be at least 0.05 mm, preferably at least 0.1 mm, further preferably 0.15 mm, thicker than the layer 17*b*, in particular steel layer, of the male die 4*b*. Through such different thicknesses of the layer 17*b* of the female die 4*a* and of the male die 4*b*, it can be achieved that the retention force with which the female die 4*a* is arranged, in particular magnetically, on the embossing roller 2*a* is higher than the retention force with which the male die 4*b* is arranged, in particular magnetically, on the counter-pressure roller 2*b*.

Further, it is also possible for the female die 4*a* and/or male die 4*b*, in particular the layer 17*a* of the female die 4*a* and/or of the male die 4*b*, to comprise plastics, in particular photopolymers. Thus, it is also possible for the female die 4*a* and/or the male die 4*b*, in particular the layer of the female die 4*a* and/or of the male die 4*b* having the elevations 18*a* and/or recesses 18*b* which correspond in particular, in positive and/or negative form, to the relief shapes to be embossed, to be formed of a plastic, in particular of a photopolymer.

Likewise, it is possible for the female die 4*a* and male die 4*b*, in particular the layer 17*a* of the female die 4*a* and of the male die 4*b*, to contain different materials. Thus, it is possible for the female die 4*a*, in particular the layer 17*a* of the female die 4*a*, to be formed of metal, in particular brass, and the male die 4*b*, in particular the layer 17*a* of the male die 4*b*, to be formed of plastic, in particular of a photopolymer, natural rubber or vulcanized rubber. It is also possible for the layers of the female die 4*a* and of the male die 4*b* having the elevations 18*a* and/or recesses 18*b* which correspond in particular, in positive and/or negative form, to the relief shapes to be embossed to be formed of different materials, in particular for the layer of the female die having the elevations 18*a* and/or recesses 18*b* to be formed of metal, in particular of brass, and the layer of the male die 4*b* having the elevations 18*a* and/or recesses 18*b* to be formed of plastic, in particular a photopolymer.

Such a female die 4*b* is shown in FIG. 8*c*. The female die shown in FIG. 8*b* comprises the layers 17*a*, 17*b* and 17*c*. The layer 17*a* is a layer of plastic, in particular a photopolymer. With respect to the design of the adhesive layer 17*c* and of the layer 17*b*, reference is made here to the above statements.

However, it is also possible for the female die 4*a* and/or male die 4*b* to be designed single-layered. Preferably, the single-layered female die 4*a* and/or male die 4*b* is magnetic. Advantageously, the single-layered female die 4*a* and/or male die 4*b* is formed of a magnetic, in particular strongly magnetic, material. Preferably, the single-layered female die 4*a* and/or male die 4*b* comprises ferromagnetic materials, in particular comprising iron, ferrites, cobalt and/or nickel.

Thus, it is possible for the single-layered female die 4*a* and/or male die 4*b* to be formed of steel. The female die 4*a* and/or male die 4*b* can thus be in particular a single-layered steel female die and/or steel male die.

In the case of a single-layered female die 4*a* and/or male die 4*b*, it is also advantageous if the female die 4*a* is thicker, is preferably between 1.2 and 3.5 times, further preferably between 1.2 and 2.5 times, thicker than the male die 4*b*. Here too, it is possible for the female die 4*a* to be at least 0.05 mm, preferably at least 0.1 mm, further preferably at least 0.15 mm, thicker than the male die 4*b*.

Preferably, the female die 4*a* has a thickness between 0.1 mm and 5 mm, preferably between 0.5 mm and 3 mm, and/or the male die 4*b* has a thickness between 0.1 mm and 5 mm, preferably between 0.5 mm and 3 mm.

FIG. 9*a* and FIG. 9*b* schematically show sectional representations of female dies 4*a* and/or male dies 4*b*.

FIG. 9*a* shows a female die 4*a*, wherein the female die 4*a* is deformed such that the female die 4*a* has a curvature which substantially corresponds to the diameter of an embossing roller 2*a*, on which the female die 4*a* is arranged. The female die 4*a* shown in FIG. 9*a* preferably has the multi-layered structure of the female die 4*a* shown in FIG. 8*a*, which is, however, not represented graphically here for simplicity.

FIG. 9*b* shows a male die 4*b* corresponding to the female die 4*a* of FIG. 9*a*, wherein the male die 4*b* is deformed such that the male die 4*b* has a curvature which substantially corresponds to the diameter of the counter-pressure roller 2*b*, on which the male die 4*b* is arranged.

The curvatures is preferably produced by bending, in particular by free bending, press brake bending, swing folding or roll bending.

FIG. 10*a* to FIG. 10*g*, FIG. 11*a* to FIG. 11*e* as well as FIG. 12*a* to FIG. 12*d* schematically show sectional representations of relief shapes.

The relief shapes shown in FIG. 10*a* to FIG. 10*g*, FIG. 11*a* to FIG. 11*e* as well as FIG. 12*a* to FIG. 12*d* can be produced by means of the method for rotary blind embossing and by means of the device for rotary blind embossing. As stated above, depending on the desired relief shape to be embossed, the female die 4*a* and the male die 4*b* have elevations 18*a* and/or recesses 18*b* here which correspond in particular, in positive and/or negative form, to the relief shapes to be embossed.

Figure 10A:
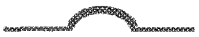
Figure 10B:
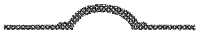
Figure 10C:
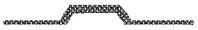
Figure 10D:
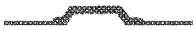
Figure 10E:
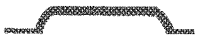
Figure 10F:
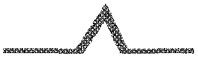
Figure 10G:
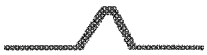

Thus, single-level relief shapes are shown in cross section in FIG. 10*a* to FIG. 10*g*, which are designed raised, i.e. the relief shapes are embossed in the substrate 3 in particular according to an embossing. FIG. 10*a* shows a raised round relief shape, FIG. 10*b* a raised round relief shape with outline, FIG. 10*c* a raised flat relief shape with angular transition, FIG. 10*d* a raised flat and angular relief shape with outline, FIG. 10*e* a raised relief shape with rounded transition, FIG. 10*f* a raised prismatic relief shape with pointed apex and FIG. 10*g* a raised prismatic relief shape with flat apex.

Figure 11A:
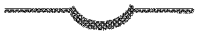
Figure 11B:
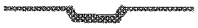
Figure 11C:
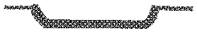
Figure 11D:
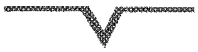
Figure 11E:
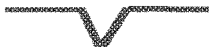

Further, single-level relief shapes are shown in cross section in FIG. 11*a* to FIG. 11*e*, which are designed recessed, i.e. the relief shapes are embossed in the substrate 3 in particular according to a debossing. FIG. 11*a* shows a recessed round relief shape, FIG. 11*b* a recessed round relief shape with angular transition, FIG. 11*c* a recessed flat relief shape with rounded transition, FIG. 11*d* recessed prismatic relief shape with pointed apex and FIG. 11*e* a recessed prismatic relief shape with flat apex.

Figure 12A:
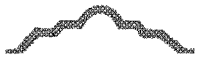
Figure 12B:
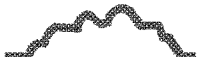
Figure 12C:
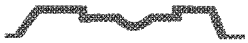
Figure 12D:
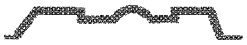

Furthermore, multi-level relief shapes are shown in cross section in FIG. 12*a* to FIG. 12*d*, which are designed raised or a combination of raised and recessed, i.e. the relief shapes are embossed in the substrate 3 in particular according to an embossing or according to an embossing and a debossing. FIG. 12*a* shows a raised multi-level relief shape, FIG. 11*b* a raised sculptured relief shape, FIG. 11*c* a multi-level combination of raised and recessed relief shapes and FIG. 11*d* likewise a multi-level combination of raised and recessed relief shapes. Further, it is also possible to produce, for example, multi-level recessed relief shapes. Further combinations of multi-level, raised and recessed relief shapes are further conceivable.

By sculptured is preferably meant a relief shape which represents or forms a sculpture, a motif, a pattern or lettering.

By means of the method for rotary blind embossing and by means of the device for rotary blind embossing, the relief shapes shown in FIG. 10*a* to FIG. 10*g*, FIG. 11*a* to FIG. 11*e* as well as FIG. 12*a* to FIG. 12*d* can be produced in high quality and large quantity, wherein by high quality is meant in particular an embossing result that is comparable with the vertical stamping method.

Corresponding to the relief shapes shown in FIG. 10*a* to FIG. 10*g*, FIG. 11*a* to FIG. 11*e* as well as FIG. 12*a* to FIG. 12*d*, the female die 4*a* and the male die 4*b* have, depending on the desired relief shape to be embossed, the corresponding elevations 18*a* and/or recesses 18*b* here which correspond in particular, in positive and/or negative form, to the relief shapes to be embossed.

Thus, it is possible for the elevations 18*a* and/or recesses 18*b* of the female die 4*a* and/or of the male die 4*b* to have a shape selected from the group: round, flat, round and flat, flat and angular, prismatic, prismatic and flat, pointed or mixed forms of these shapes.

Further, it is possible for the elevation 18*a* and/or recess 19*b* of the female die 4*a* and/or male die 4*b* to be designed multi-level, in particular sculptured, in its height and/or its depth.

Figure 13A:
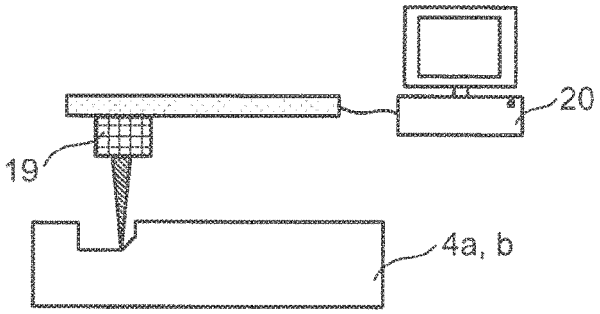
FIG. 13*a* and FIG. 13*b* show methods for producing a female die and/or male die
Figure 13B:
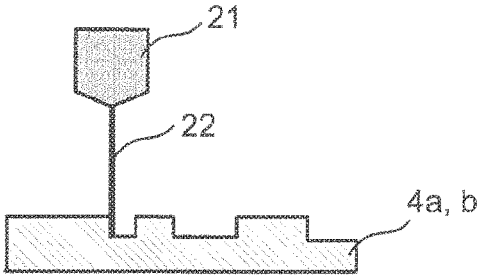

FIG. 13*a* and FIG. 13*b* show methods for producing a female die 4*a* and/or male die 4*b*.

As shown in FIG. 13*a*, it is possible for the elevation 18*a* and/or recess 18*b* to be engraved and/or milled by means of a computer-controlled engraving machine and/or by means of a computer-controlled milling machine 19. For this purpose, first of all the relief shape is preferably defined and designed with the aid of a computer 20. The design can be effected manually or by means of predetermined relief shapes here. Then, on the basis of this design a dataset is preferably generated, which contains the relief shape, and the dataset is transferred to the computer-controlled engraving machine and/or milling machine 19. The elevations and/or recesses are then engraved and/or milled into the female die 4*a* and/or male die 4*b*, in particular as a function of the dataset.

Alternatively, it is also possible for the elevations 18*a* and/or recesses 18*b* to be produced by photolithography.

Further, it is also possible, as shown in FIG. 13*b*, for the elevations 18*a* and/or recesses 18*b* to be produced by means of a laser 20, in particular by laser ablation.

In the case of laser ablation, the material of the female die 4*a* and/or of the male die 4*b* is preferably completely removed and/or ablated.

The laser 20 is preferably a gas laser, in particular a $CO_2$ laser, and/or a solid-state laser, in particular an Nd:YAG laser. The laser power is advantageously at least 20 W, preferably at least 30 W, further preferably at least 100 W. It is further advantageous if the wavelength of the laser 20 is between 9.35 μm and 10.25 μm.

The laser beam 22 here is preferably deflected along the female die 4*a* and/or the male die by means of movable mirrors, in particular by means of a laser scanning module, with the result that the desired elevations 18*a* and/or recesses 18*b* are produced. The beam diameter of the laser 21 in the focal point here is in particular between 0.01 mm and 1 mm, preferably between 0.01 mm and 0.2 mm.

In particular in the production of the female die 4*a* and/or male die 4*b*, it is further advantageous if the desired relief shape to be embossed are reduced in size by a predetermined reduction factor in particular before the elevations 18*a* and/or recess 18*b* are produced in the surface of the female die 4*a* and/or male die 4*a*. Preferably, the reduction factor is in particular between 0.95 and 1, preferably between 0.9750 and 0.9999, further preferably between 0.98000 and 0.99999, still further preferably between 0.99000 and 0.9999. The predetermined reduction factor is advantageously determined as a function of the diameter of the embossing roller and/or of the counter-pressure roller. Further, it is possible for the predetermined reduction factor to be determined as a function of the embossing length and/or of a printing length, in particular on the substrate. In the case of the production method shown in FIG. 13*a* and FIG. 13*b*, the predetermined reduction factor for the female die 4*a* is 0.99440 and for the male die 4*b* is 0.99800 with a diameter of the embossing roller 2*a* of 300 mm and a diameter of the counter-pressure roller of 600 mm.

Regions of the at least one female die 4*a* and/or male die 4*b*, which are not to emboss the substrate 3, are preferably removed or cropped. In particular, the male die 4*b* is removed or cropped here such that the so-called base of the female die 2*a* is not embossed in the substrate 3. Here, the male die 4*b* is preferably removed or cropped by at least 0.2 mm, further preferably by at least 0.3 mm, still further preferably by at least 0.4 mm.

Preferably, the elevations 18*a* and/or recesses 18*b* are introduced in flat states of the female die 4*a* and/or of the male die 4*b* and the female die 4*a* and/or the male die 4*b* is then deformed such that the female die 4*a* and/or male die 4*b* has a curvature which substantially corresponds to the diameter of the embossing roller 2*a* and/or the diameter of the counter-pressure roller 2*b*. Further, it is possible in a further step for the layer 17*b* to be applied by means of the adhesive layer 17*c*, wherein the layer 17*b* preferably already has a corresponding curvature.

LIST OF REFERENCE NUMBERS

1 device
1*a*, 1*b*, 1*c*, 1*d* work stations
2*a* embossing roller
2*b* counter-pressure roller
3 substrate
4*a* female die
4*b* male die
5*a* elevation of the substrate
5*b* depression of the substrate
6 fixing device
7 positioning aid
7*a* window region
7*ab* width of the window region
7*al* length of the window region
7*b* clamping device
7*c* width of the positioning aid
7*d* length of the positioning aid
7*e* thickness of the positioning aid
7*f* increased thickness of the positioning aid
8 compensation layer
9*a* adjusting aid
9*b* fastening device
10*a*, 10*b*, 10*c*, 10*d*, 10*e* method steps
11 transport device
12*a* embossing cylinder
12*b* counter-pressure cylinder
13 detail
14 motif
16 region
17*a* first metal layer
17*b* second metal layer
17*c* adhesive layer
18*a* elevation of the female die/male die
18*b* recess of the female die/male die
19 engraving machine, milling machine
20 computer

21 laser
22 laser beam

The invention claimed is:

1. A method for rotary blind embossing of a substrate in a work station comprising an embossing roller and a counter-pressure roller, wherein the method comprises the following steps:

providing the substrate;

blind embossing the substrate by means of at least one female die arranged on the embossing roller and at least one male die arranged on the counter-pressure roller;

providing a positioning aid comprising at least one window region, the at least one window region being larger than the at least one female die and/or male die;

arranging the positioning aid on the embossing roller and/or the counter-pressure roller;

arranging the at least one female die and/or male die in the at least one window region of the positioning aid such that a gap is formed between an edge of the at least one window region and an edge of the at least one female die and/or male die; and adjusting a position of the at least one female die and/or male die within the at least one window region of the positioning aid by inserting an adjusting aid in the gap formed in the at least one window region, wherein the adjusting aid is arranged such that the at least one female die and/or male die is movable at least in one direction.

2. The method according to claim 1, wherein, the method further comprises the following steps:

fixing the at least one female die on the embossing roller and/or the at least one male die on the counter-pressure roller by means of a fixing device.

3. The method according to claim 1, wherein, when the at least one female die and/or male die is arranged in the at least one window region of the positioning aid, the at least one female die and/or male die is fastened by means of a fastening device in the at least window region.

4. The method according to claim 1, wherein the at least one female die and/or male die is deformed, before being arranged in the at least one window region of the positioning aid, such that the at least one female die and/or male die has a curvature which substantially corresponds to the diameter of the embossing roller and/or the diameter of the counter-pressure roller.

5. The method according to claim 1, wherein the positioning aid is clamped onto the embossing roller and/or the counter-pressure roller such that the positioning aid has a curvature which substantially corresponds to the diameter of the embossing roller and/or the diameter of the counter-pressure roller.

6. The method according to claim 1, wherein the at least one female die is magnetically attached to the embossing roller and/or the at least one male die is magnetically attached to the counter-pressure roller.

7. The method according to claim 1, wherein the at least one female die is arranged on the embossing roller and the at least one male die is arranged on the counter-pressure roller such that the retention force with which the at least one female die is arranged on the embossing roller is higher, than the retention force with which the at least one male die is arranged on the counter-pressure roller.

8. The method according to claim 1, wherein the embossing roller and the counter-pressure roller are driven in opposite directions to each other with corresponding rotational speeds.

9. The method according to claim 8, wherein the at least one female die and the at least one male die engage with each other on every revolution such that the substrate located between the at least one female die and the at least one male die is embossed.

10. The method according to claim 9, wherein the substrate is embossed such that the deviations between the embossings of each revolution are less than 2% percent.

11. The method according to claim 1, wherein the method further comprises at least one of the following steps, which are performed in one or more further work stations:

printing the substrate;

severing the substrate;

grooving and/or folding the substrate.

12. The method according to claim 1, wherein the substrate is provided in sheets.

13. The method according to claim 12, wherein the deviations between the embossings on the sheets of the substrate provided in sheets are less than 2% percent.

14. The method according to claim 12, wherein more than 8000 sheets per hour of the substrate provided in sheets are processed by means of the method.

15. The method according to claim 1, wherein the adjusting aid comprises at least one plate and/or gauge block and/or feeler gauge, and the step of adjusting comprises inserting one or more of the plate and/or gauge block and/or feeler gauge into the gap formed in the at least one window region.

16. A device for rotary blind embossing of a substrate, wherein the device comprises a work station which comprises an embossing roller and a counter-pressure roller, and wherein at least one female die is arranged on the embossing roller and at least one male die is arranged on the counter-pressure roller, and wherein the device has a positioning aid with at least one window region, the at least one window region being larger than the at least one female die and/or male die, wherein the positioning aid is arranged on the embossing roller and/or the counter-pressure roller and the at least one female die and/or male die is arranged in the at least one window region of the positioning aid such that a gap is formed between an edge of the at least one window region and an edge of the at least one female die and/or male die, and wherein a position of the at least one female die and/or male die within the at least one window region of the positioning aid can be adjusted by means of an adjusting aid inserted in the gap in the at least one window region of the positioning aid, and wherein the adjusting aid is arranged such that the at least one female die and/or male die is movable at least in one direction.

17. The device according to claim 16, wherein the at least one female die is introduced as at least one elevation and/or recess into the surface of an embossing cylinder which is arranged on the embossing roller and/or wherein the at least one male die is introduced as at least one elevation and/or recess into the surface of a counter-pressure cylinder which is arranged on the counter-pressure roller.

18. The device according to claim 16, wherein the positioning aid comprises metals.

19. The device according to claim 16, wherein the positioning aid is formed to be magnetic.

20. The device according to claim 16, wherein the positioning aid has a thickness that is increased compared with the remaining thickness of the positioning aid in a region around the at least one window region.

21. The device according to claim 16, wherein the positioning aid has a width of at least 250 mm, and a length of at least 500 mm, and/or wherein the at least one window region has a width of at least 5 mm, and a length of at least 10 mm.

22. The device according to claim 16, wherein the at least one female die is arranged on the embossing roller and the at least one male die is arranged on the counter-pressure roller such that the retention force with which the at least one female die is arranged on the embossing roller is higher, than the retention force with which the at least one male die is arranged on the counter-pressure roller.

23. The device according to claim 16, wherein the ratio of the diameter of the embossing roller to the diameter of the counter-pressure roller is 1 to 2.

24. The device according to claim 16, wherein the device further comprises one or more further work stations for printing the substrate and/or for severing the substrate and/or for grooving and/or folding the substrate.

25. The device according to claim 16, wherein the adjusting aid comprises at least one plate and/or gauge block and/or feeler gauge.

* * * * *